US009080810B2

(12) United States Patent
Pitman et al.

(10) Patent No.: US 9,080,810 B2
(45) Date of Patent: Jul. 14, 2015

(54) HYDROCARBON GAS PROCESSING

(75) Inventors: Richard N. Pitman, Sunset, TX (US); John D. Wilkinson, Midland, TX (US); Joe T. Lynch, Midland, TX (US); Hank M. Hudson, Midland, TX (US); Kyle T. Cuellar, Katy, TX (US); Tony L. Martinez, Odessa, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 1523 days.

(21) Appl. No.: 11/430,412

(22) Filed: May 9, 2006

(65) Prior Publication Data

US 2006/0283207 A1 Dec. 21, 2006

Related U.S. Application Data

(60) Provisional application No. 60/692,126, filed on Jun. 20, 2005.

(51) Int. Cl.
*F25J 3/00* (2006.01)
*F25J 3/02* (2006.01)

(52) U.S. Cl.
CPC ..... *F25J 3/0209* (2013.01); *F25J 3/0233* (2013.01); *F25J 3/0238* (2013.01); (Continued)

(58) Field of Classification Search
USPC ..... 62/620, 621, 618, 619
See application file for complete search history.

(56) References Cited

U.S. PATENT DOCUMENTS 3,292,380 A 12/1966 Bucklin ..... 62/20
3,675,435 A 7/1972 Jackson et al. ..... 62/622

(Continued)

FOREIGN PATENT DOCUMENTS

| | | |
|---|---|---|
| EP | 0182643 | 1/1992 |
| WO | 00/34724 | 6/2000 |
| WO | 02/14763 | 2/2002 |

OTHER PUBLICATIONS

Mowrey, E. Ross, "Efficient, High Recovery of Liquids from Natural Gas Utilizing a High Pressure Absorber", Proceedings of the Eighty-First Annual Convention of the Gas Processors Association, Dallas, Texas, Mar. 11-13, 2002.

*Primary Examiner* — John F Pettitt

(74) *Attorney, Agent, or Firm* — Fitzpatrick, Cella, Harper & Scinto

(57) ABSTRACT

A process for the recovery of ethane, ethylene, propane, propylene, and heavier hydrocarbon components from a hydrocarbon gas stream is disclosed. The stream is cooled and is thereafter expanded to the fractionation tower pressure and supplied to the fractionation tower at a lower mid-column feed position. A distillation stream is withdrawn from the column below the feed point of the stream and is then directed into heat exchange relation with the tower overhead vapor stream to cool the distillation stream and condense at least a part of it, forming a condensed stream. At least a portion of the condensed stream is directed to the fractionation tower at an upper mid-column feed position. A recycle stream is withdrawn from the tower overhead after it has been warmed and compressed. The compressed recycle stream is cooled sufficiently to substantially condense it, and is then expanded to the pressure of the fractionation tower and supplied to the tower at a top column feed position. The quantities and temperatures of the feeds to the fractionation tower are effective to maintain the overhead temperature of the fractionation tower at a temperature whereby the major portion of the desired components is recovered.

4 Claims, 10 Drawing Sheets

(52) U.S. Cl.
CPC ..... *F25J 2200/02* (2013.01); *F25J 2200/04* (2013.01); *F25J 2200/70* (2013.01); *F25J 2200/76* (2013.01); *F25J 2200/78* (2013.01); *F25J 2205/02* (2013.01); *F25J 2205/04* (2013.01); *F25J 2220/66* (2013.01); *F25J 2230/08* (2013.01); *F25J 2235/60* (2013.01); *F25J 2240/02* (2013.01); *F25J 2280/02* (2013.01); *F25J 2290/40* (2013.01); *F25J 2290/80* (2013.01)

(56) References Cited

U.S. PATENT DOCUMENTS

| | | | | |
|---|---|---|---|---|
| 4,061,481 | A | 12/1977 | Campbell et al. | 62/621 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,318,723 | A | 3/1982 | Holmes et al. | 62/632 |
| 4,519,824 | A | 5/1985 | Huebel | 62/621 |
| 4,596,588 | A | 6/1986 | Cook | 62/621 |
| 4,617,039 | A | 10/1986 | Buck | 62/621 |
| 4,657,571 | A | 4/1987 | Gazzi | 62/27 |
| 4,687,499 | A | 8/1987 | Aghili | 62/621 |
| 4,689,063 | A | 8/1987 | Paradowski et al. | 62/627 |
| 4,690,702 | A | 9/1987 | Paradowski et al. | 62/621 |
| 4,705,549 | A | 11/1987 | Sapper | 62/625 |
| 4,854,955 | A | 8/1989 | Campbell et al. | 62/621 |
| 4,869,740 | A | 9/1989 | Campbell et al. | 62/621 |
| 4,889,545 | A | 12/1989 | Campbell et al. | 62/621 |
| 4,895,584 | A | 1/1990 | Buck et al. | 62/621 |
| RE33,408 | E | 10/1990 | Khan | 62/29 |
| 4,966,612 | A | 10/1990 | Bauer | 62/622 |
| 5,275,005 | A | 1/1994 | Campbell et al. | 62/621 |
| 5,291,736 | A | 3/1994 | Paradowski | 62/613 |
| 5,555,748 | A | 9/1996 | Campbell et al. | 62/621 |
| 5,568,737 | A | 10/1996 | Campbell et al. | 62/621 |
| 5,685,170 | A | 11/1997 | Sorensen | 62/625 |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,378 | A | 4/1999 | Rambo et al. | 62/621 |
| 5,983,664 | A | 11/1999 | Campbell et al. | 62/621 |
| 5,992,175 | A | 11/1999 | Yao et al. | 62/621 |
| 6,116,050 | A | 9/2000 | Yao et al. | 62/630 |
| 6,182,469 | B1 | 2/2001 | Campbell et al. | 62/621 |
| 6,244,070 | B1 | 6/2001 | Lee et al. | 62/620 |
| 6,453,698 | B2 | 9/2002 | Jain et al. | 62/621 |
| 6,712,880 | B2 | 3/2004 | Foglietta et al. | 95/184 |
| 6,915,662 | B2 | 7/2005 | Wilkinson et al. | 62/621 |
| 2002/0166336 | A1 | 11/2002 | Wilkinson et al. | 62/620 |
| 2004/0172967 | A1 | 9/2004 | Patel et al. | |
| 2006/0032269 | A1 | 2/2006 | Cuellar et al. | 62/620 |

HYDROCARBON GAS PROCESSING

BACKGROUND OF THE INVENTION

This invention relates to a process for the separation of a gas containing hydrocarbons. The applicants claim the benefits under Title 35, United States Code, Section 119(e) of prior U.S. Provisional Application No. 60/692,126 which was filed on Jun. 20, 2005.

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes, and the like, as well as hydrogen, nitrogen, carbon dioxide, and other gases.

The present invention is generally concerned with the recovery of ethylene, ethane, propylene, propane, and heavier hydrocarbons from such gas streams. A typical analysis of a gas stream to be processed in accordance with this invention would be, in approximate mole percent, 91.6% methane, 4.2% ethane and other $C_2$ components, 1.3% propane and other $C_3$ components, 0.4% iso-butane, 0.3% normal butane, 0.5% pentanes plus, 1.4% carbon dioxide, with the balance made up of nitrogen. Sulfur containing gases are also sometimes present.

The historically cyclic fluctuations in the prices of both natural gas and its natural gas liquid (NGL) constituents have at times reduced the incremental value of ethane, ethylene, propane, propylene, and heavier components as liquid products. This has resulted in a demand for processes that can provide more efficient recoveries of these products, for processes that can provide efficient recoveries with lower capital investment and lower operating costs, and for processes that can be easily adapted or adjusted to vary the recovery of a specific component over a broad range. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,568,737; 5,771,712; 5,799,507; 5,881,569; 5,890,378; 5,983,664; 6,182,469; 6,712,880; 6,915,662; reissue U.S. Pat. No. 33,408; U.S. Application Publ. No. 2002/0166336 A1; and co-pending application Ser. No. 11/201,358 describe relevant processes (although the description of the present invention in some cases is based on different processing conditions than those described in the cited patents and applications).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ or $C_3$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product, or to separate residual methane, $C_2$ components, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be passed through a work expansion machine or engine, or an expansion valve, to a lower pressure at which additional liquids are condensed as a result of further cooling of the stream. The pressure after expansion is essentially the same as the pressure at which the distillation column is operated. The expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier hydrocarbon components with essentially no methane or more volatile components. In practice, however, this ideal situation is not obtained for two main reasons. The first reason is that the conventional demethanizer is operated largely as a stripping column. The methane product of the process, therefore, typically comprises vapors leaving the top fractionation stage of the column, together with vapors not subjected to any rectification step. Considerable losses of $C_2$, $C_3$, and $C_4$+ components occur because the top liquid feed contains substantial quantities of these components, resulting in corresponding equilibrium quantities of $C_2$ components, $C_3$ components, $C_4$ components, and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_2$ components, $C_3$ components, $C_4$ components, and heavier hydrocarbon components from the vapors.

The second reason that this ideal situation cannot be obtained is that carbon dioxide contained in the feed gas fractionates in the demethanizer and can build up to concentrations of as much as 5% to 10% or more in the tower even when the feed gas contains less than 1% carbon dioxide. At such high concentrations, formation of solid carbon dioxide can occur depending on temperatures, pressures, and the liquid solubility. It is well known that natural gas streams usually contain carbon dioxide, sometimes in substantial amounts. If the carbon dioxide concentration in the feed gas is high enough, it becomes impossible to process the feed gas as desired due to blockage of the process equipment with solid carbon dioxide (unless carbon dioxide removal equipment is added, which would increase capital cost substantially). The present invention provides a means for generating a supplemental liquid reflux stream that will improve the recovery efficiency for the desired products while simultaneously substantially mitigating the problem of carbon dioxide icing.

In recent years, the preferred processes for hydrocarbon separation use an upper absorber section to provide additional rectification of the rising vapors. The source of the reflux stream for the upper rectification section is typically a recycled stream of residue gas supplied under pressure. The recycled residue gas stream is usually cooled to substantial condensation by heat exchange with other process streams, e.g., the cold fractionation tower overhead. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams, so that thereafter the vapor is combined with the tower overhead and the liquid is supplied to the column as a top column feed. Typical process schemes of this type are disclosed in U.S. Pat. Nos. 4,889,545; 5,568,737; 5,881,569; 6,712,880; and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11-13, 2002.

The present invention also employs an upper rectification section (or a separate rectification column in some embodiments). However, two reflux streams are provided for this rectification section. The upper reflux stream is a recycled stream of residue gas as described above. In addition, however, a supplemental reflux stream is provided at a lower feed point by using a side draw of the vapors rising in a lower portion of the tower (which may be combined with some of the separator liquids). Because of the relatively high concentration of $C_2$ components and heavier components in the vapors lower in the tower, a significant quantity of liquid can be condensed in this side draw stream without elevating its pressure, often using only the refrigeration available in the cold vapor leaving the upper rectification section. This condensed liquid, which is predominantly liquid methane and ethane, can then be used to absorb $C_3$ components, $C_4$ components, and heavier hydrocarbon components from the vapors rising through the lower portion of the upper rectification section and thereby capture these valuable components in the bottom liquid product from the demethanizer. Since the lower reflux stream captures essentially all of the $C_3$+ components, only a relatively small flow rate of liquid in the upper reflux stream is needed to absorb the $C_2$ components remaining in the rising vapors and likewise capture these $C_2$ components in the bottom liquid product from the demethanizer.

Heretofore, such a vapor side draw feature has been employed in $C_3$+ recovery systems, as illustrated in the assignee's U.S. Pat. No. 5,799,507. The process and apparatus of U.S. Pat. No. 5,799,507, however, are unsuitable for high ethane recovery. Surprisingly, applicants have found that $C_2$ recoveries may be improved without sacrificing $C_3$+ component recovery levels or system efficiency by combining the side draw feature of the assignee's U.S. Pat. No. 5,799,507 invention with the residue reflux feature of the assignee's U.S. Pat. No. 5,568,737.

In accordance with the present invention, it has been found that $C_2$ component recoveries in excess of 97 percent can be obtained with no loss in $C_3$+ component recovery. The present invention provides the further advantage of being easily adapted to using much of the equipment required to implement assignee's U.S. Pat. No. 5,799,507, resulting in lower capital investment costs compared to other prior art processes. In addition, the present invention makes possible essentially 100 percent separation of methane and lighter components from the $C_2$ components and heavier components while maintaining the same recovery levels as the prior art and improving the safety factor with respect to the danger of carbon dioxide icing. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

For a better understanding of the present invention, reference is made to the following examples and drawings. Referring to the drawings:

FIG. 1 is a flow diagram of a prior art natural gas processing plant in accordance with U.S. Pat. No. 5,799,507;

FIG. 2 is a flow diagram of a base case natural gas processing plant modifying a design in accordance with U.S. Pat. No. 5,568,737;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

Figure 1:
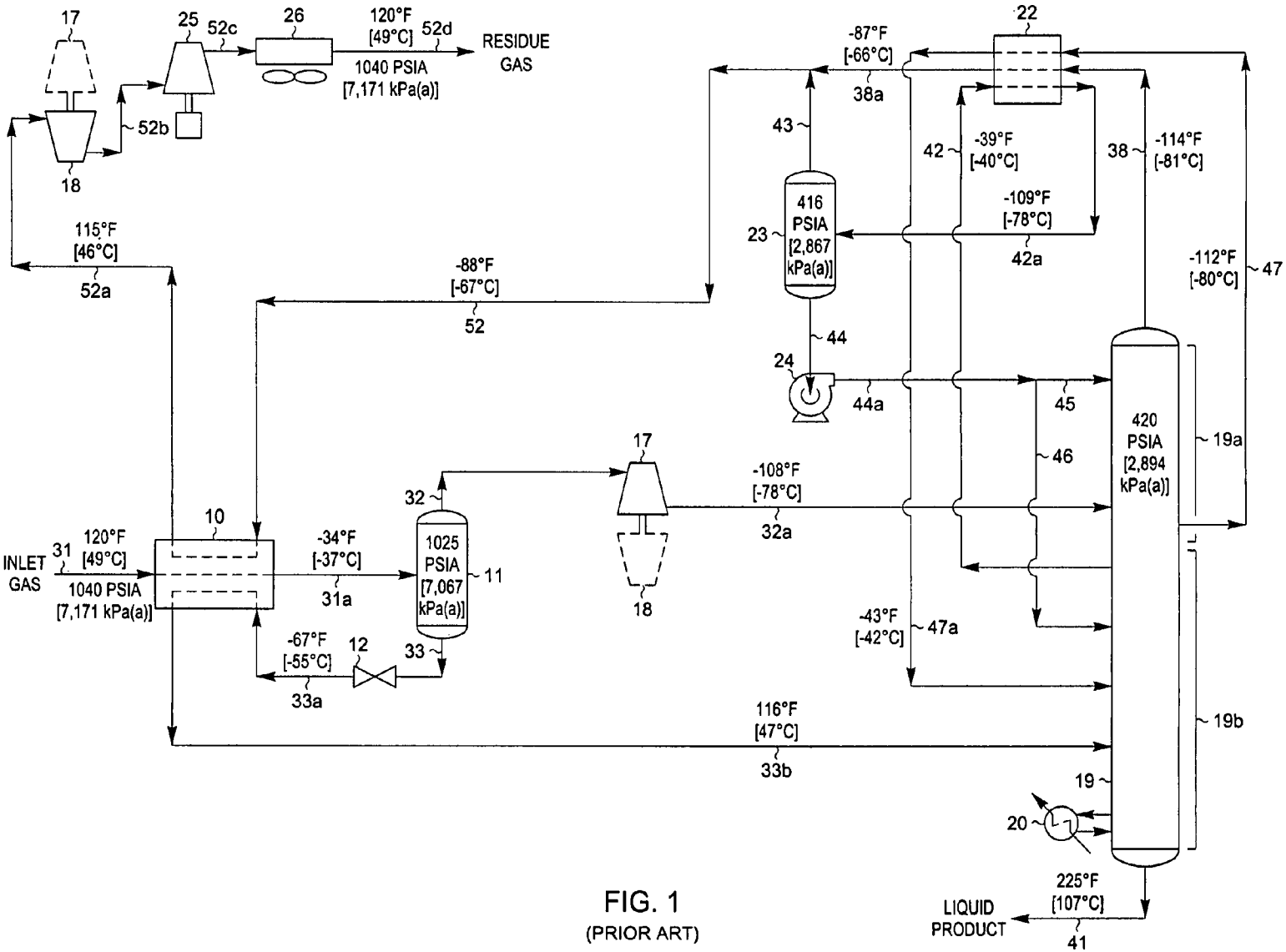
FIG. 1 (PRIOR ART)

FIG. 1 is a process flow diagram showing the design of a processing plant to recover $C_3$+ components from natural gas using prior art according to assignee's U.S. Pat. No. 5,799,507. In this simulation of the process, inlet gas enters the plant at 120° F. [49° C.] and 1040 psia [7,171 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with cool residue gas at −88° F. [−67° C.] (stream 52) and flash expanded separator liquids (stream 33*a*). The cooled stream 31*a* enters separator 11 at −34° F. [−37° C.] and 1025 psia [7,067 kPa(a)] where the vapor (stream 32) is separated from the condensed liquid (stream 33). The separator liquid (stream 33) is expanded to slightly above the operating pressure of fractionation tower 19 by expansion valve 12, cooling stream 33*a* to −67° F. [−55° C.]. Stream 33*a* enters heat exchanger 10 to supply cooling to the feed gas as described previously, heating stream 33*b* to 116° F. [47° C.] before it is supplied to fractionation tower 19 at a lower mid-column feed point.

The separator vapor (stream 32) enters a work expansion machine 17 in which mechanical energy is extracted from this portion of the high pressure feed. The machine 17 expands the vapor substantially isentropically to the tower operating pressure of approximately 420 psia [2,894 kPa(a)], with the work expansion cooling the expanded stream 32*a* to a temperature of approximately −108° F. [−78° C.]. The typical commercially available expanders are capable of recovering on the order of 80-88% of the work theoretically available in an ideal isentropic expansion. The work recovered is often used to drive a centrifugal compressor (such as item 18) that can be used to re-compress the residue gas (stream 52*a*), for example. The partially condensed expanded stream 32*a* is thereafter supplied as feed to fractionation tower 19 at an upper mid-column feed point.

The deethanizer in tower 19 is a conventional distillation column containing a plurality of vertically spaced trays, one or more packed beds, or some combination of trays and packing. The deethanizer tower consists of two sections: an upper absorbing (rectification) section 19*a* that contains the trays and/or packing to provide the necessary contact between the vapor portion of the expanded stream 32*a* rising upward and cold liquid falling downward to condense and absorb the $C_3$ components and heavier components; and a lower, stripping section 19*b* that contains the trays and/or packing to provide the necessary contact between the liquids falling downward and the vapors rising upward. The deethanizing section 19*b* also includes at least one reboiler (such as reboiler 20) which heats and vaporizes a portion of the liquids flowing down the column to provide the stripping vapors which flow up the column to strip the liquid product, stream 41, of methane, $C_2$ components, and lighter components. Stream 32*a* enters deethanizer 19 at an upper mid-column feed position located in the lower region of absorbing section 19*a* of deethanizer 19. The liquid portion of expanded stream 32*a* commingles with liquids falling downward from the absorbing section 19*a* and the combined liquid continues downward into the stripping section 19*b* of deethanizer 19. The vapor portion of expanded stream 32*a* rises upward through absorbing section 19*a* and is contacted with cold liquid falling downward to condense and absorb the $C_3$ components and heavier components.

A portion of the distillation vapor (stream 42) is withdrawn from the upper region of stripping section 19*b*. This stream is then cooled and partially condensed (stream 42*a*) in exchanger 22 by heat exchange with cold deethanizer overhead stream 38 which exits the top of deethanizer 19 at −114° F. [−81° C.] and with a portion of the cold distillation liquid (stream 47) withdrawn from the lower region of absorbing section 19*a* at −112° F. [−80° C.]. The cold deethanizer overhead stream is warmed to approximately −87° F. [−66° C.] (stream 38*a*) and the distillation liquid is heated to −43° F. [−42° C.] (stream 47*a*) as they cool stream 42 from −39° F. [−40° C.] to about −109° F. [−78° C.] (stream 42*a*). The heated and partially vaporized distillation liquid (stream 47*a*) is then returned to deethanizer 19 at a mid-point of stripping section 19*b*.

The operating pressure in reflux separator 23 is maintained slightly below the operating pressure of deethanizer 19. This pressure difference provides the driving force that allows distillation vapor stream 42 to flow through heat exchanger 22 and thence into the reflux separator 23 wherein the condensed liquid (stream 44) is separated from the uncondensed vapor (stream 43). The uncondensed vapor stream 43 combines with the warmed deethanizer overhead stream 38*a* from exchanger 22 to form cool residue gas stream 52 at −88° F. [−67° C.].

The liquid stream 44 from reflux separator 23 is pumped by pump 24 to a pressure slightly above the operating pressure of deethanizer 19. The resulting stream 44*a* is then divided into two portions. The first portion (stream 45) is supplied as cold top column feed (reflux) to the upper region of absorbing section 19*a* of deethanizer 19. This cold liquid causes an absorption cooling effect to occur inside the absorbing (rectification) section 19*a* of deethanizer 19, wherein the saturation of the vapors rising upward through the tower by vaporization of liquid methane and ethane contained in stream 45 provides refrigeration to the section. Note that, as a result, both the vapor leaving the upper region (overhead stream 38) and the liquids leaving the lower region (liquid distillation stream 47) of absorbing section 19*a* are colder than the either of the feed streams (streams 45 and stream 32*a*) to absorbing section 19*a*. This absorption cooling effect allows the tower overhead (stream 38) to provide the cooling needed in heat exchanger 22 to partially condense the vapor distillation stream (stream 42) without operating stripping section 19*b* at a pressure significantly higher than that of absorbing section 19*a*. This absorption cooling effect also facilitates reflux stream 45 condensing and absorbing the $C_3$ components and heavier components in the distillation vapor flowing upward through absorbing section 19*a*. The second portion (stream 46) of pumped stream 44*a* is supplied to the upper region of stripping section 19*b* of deethanizer 19 where the cold liquid acts as reflux to absorb and condense the $C_3$ components and heavier components flowing upward from below so that vapor distillation stream 42 contains minimal quantities of these components.

In stripping section 19*b* of deethanizer 19, the feed streams are stripped of their methane and $C_2$ components. The resulting liquid product stream 41 exits the bottom of deethanizer 19 at 225° F. [107° C.] (based on a typical specification of a ethane to propane ratio of 0.025:1 on a molar basis in the bottom product) before flowing to storage.

The cool residue gas (stream 52) passes countercurrently to the incoming feed gas in heat exchanger 10 where it is heated to 115° F. [46° C.] (stream 52*a*). The residue gas is then re-compressed in two stages. The first stage is compressor 18 driven by expansion machine 17. The second stage is compressor 25 driven by a supplemental power source which compresses the residue gas (stream 52*c*) to sales line pressure. After cooling to 120° F. [49° C.] in discharge cooler 26, the residue gas product (stream 52*d*) flows to the sales gas pipeline at 1040 psia [7,171 kPa(a)], sufficient to meet line requirements (usually on the order of the inlet pressure).

A summary of stream flow rates and energy consumption for the process illustrated in FIG. 1 is set forth in the following table:

TABLE I (FIG. 1)

Stream Flow Summary - Lb. Moles/Hr [kg moles/Hr]

| Stream | Methane | Ethane | Propane | Butanes+ | C. Dioxide | Total |
|---|---|---|---|---|---|---|
| 31 | 25,384 | 1,161 | 362 | 332 | 400 | 27,714 |
| 32 | 25,085 | 1,104 | 315 | 186 | 389 | 27,153 |
| 33 | 299 | 57 | 47 | 146 | 11 | 561 |
| 47 | 2,837 | 1,073 | 327 | 186 | 169 | 4,595 |
| 42 | 4,347 | 1,797 | 26 | 1 | 279 | 6,452 |
| 43 | 1,253 | 69 | 0 | 0 | 25 | 1,349 |
| 44 | 3,094 | 1,728 | 26 | 1 | 254 | 5,103 |
| 45 | 1,887 | 1,054 | 16 | 1 | 155 | 3,113 |
| 46 | 1,207 | 674 | 10 | 0 | 99 | 1,990 |
| 38 | 24,131 | 1,083 | 3 | 0 | 375 | 25,665 |
| 52 | 25,384 | 1,152 | 3 | 0 | 400 | 27,014 |
| 41 | 0 | 9 | 359 | 332 | 0 | 700 |

Recoveries*

| | |
|---|---|
| Propane | 99.08% |
| Butanes+ | 99.99% |

Power

| | | |
|---|---|---|
| Residue Gas Compression | 12,774 HP | [21,000 kW] |

*(Based on un-rounded flow rates)

The FIG. 1 process is often the optimum choice for gas processing plants when recovery of $C_2$ components is not desired, because it provides very efficient recovery of the $C_3$+ components using equipment that requires less capital investment than other processes. However, the FIG. 1 process is not well suited to recovering $C_2$ components, as $C_2$ component recovery levels on the order of 40% are generally the highest that can be achieved without inordinate increases in the power requirements for the process. If higher $C_2$ component recovery levels than this are desired, a different process is usually required, such as assignee's U.S. Pat. No. 5,568,737.

Figure 2:
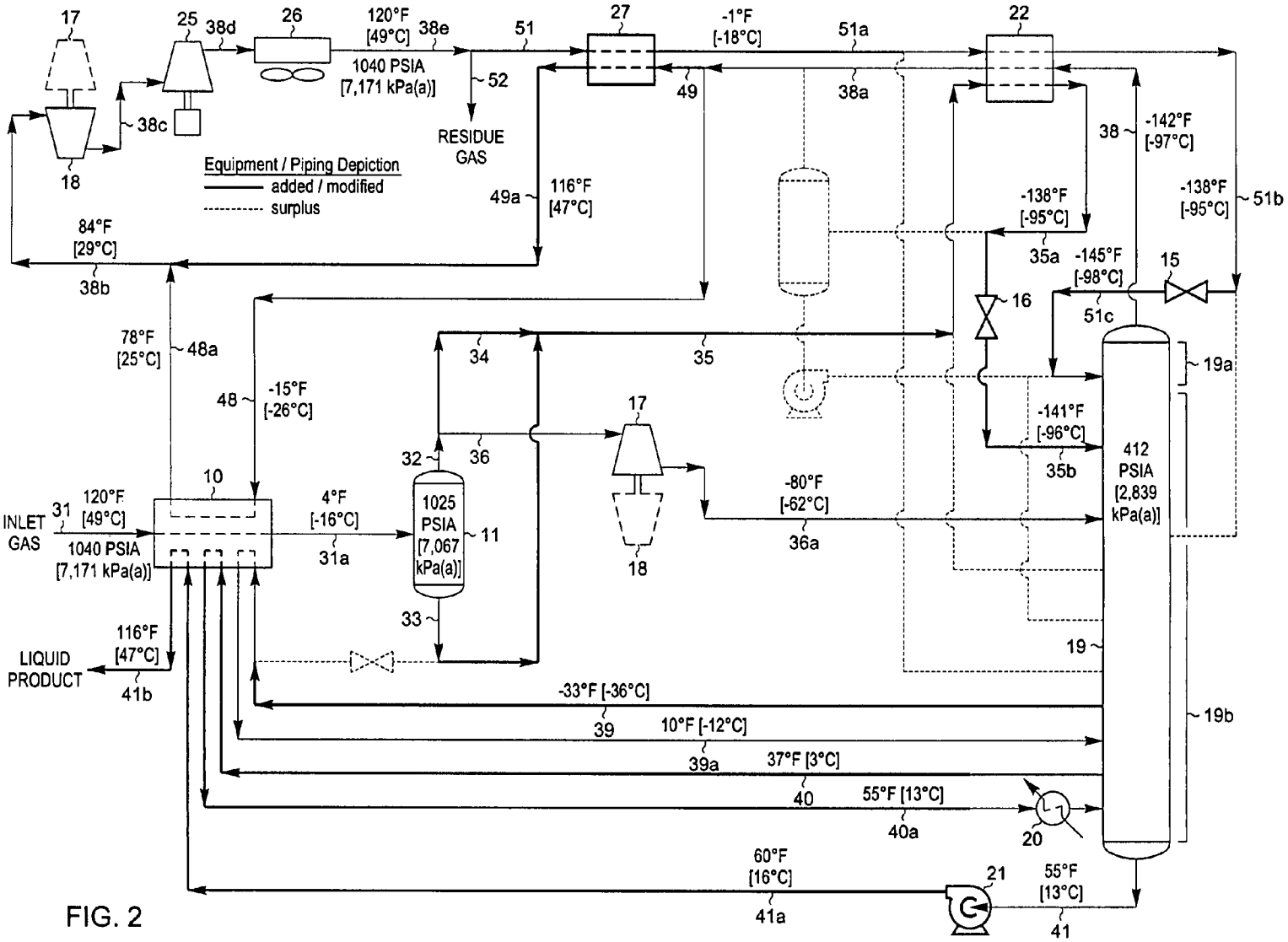

FIG. 2 is a process flow diagram showing one manner in which the design of the processing plant in FIG. 1 can be adapted to operate at a higher $C_2$ component recovery level using a base case design according to assignee's U.S. Pat. No. 5,568,737. The process of FIG. 2 has been applied to the same feed gas composition and conditions as described previously for FIG. 1. However, in the simulation of the process of FIG. 2, certain equipment and piping have been added (shown by bold lines) while other equipment and piping have been removed from service (shown by light dashed lines) so that the process operating conditions can be adjusted to increase the recovery of $C_2$ components to about 97%.

The feed stream 31 is cooled in heat exchanger 10 by heat exchange with a portion of the cool distillation column overhead stream (stream 48) at −15° F. [−26° C.], demethanizer liquids (stream 39) at −33° F. [−36° C.], demethanizer liquids (stream 40) at 37° F. [3° C.], and the pumped demethanizer bottoms liquid (stream 41*a*) at 60° F. [16° C.]. The cooled stream 31*a* enters separator 11 at 4° F. [−16° C.] and 1025 psia [7,067 kPa(a)] where the vapor (stream 32) is separated from the condensed liquid (stream 33).

The separator vapor (stream 32) is divided into two streams, 34 and 36. Stream 34, containing about 30% of the total vapor, is combined with the separator liquid (stream 33). The combined stream 35 passes through heat exchanger 22 in heat exchange relation with the cold distillation column overhead stream 38 where it is cooled to substantial condensation. The resulting substantially condensed stream 35*a* at −138° F. [−95° C.] is then flash expanded through expansion valve 16 to the operating pressure of fractionation tower 19, 412 psia [2,839 kPa(a)]. During expansion a portion of the stream is vaporized, resulting in cooling of the total stream. In the process illustrated in FIG. 2, the expanded stream 35*b* leaving expansion valve 16 reaches a temperature of −141° F. [−96° C.] and is supplied to fractionation tower 19 at an upper mid-column feed point.

The remaining 70% of the vapor from separator 11 (stream 36) enters a work expansion machine 17 in which mechanical energy is extracted from this portion of the high pressure feed. The machine 17 expands the vapor substantially isentropically to the tower operating pressure, with the work expansion cooling the expanded stream 36*a* to a temperature of approximately −80° F. [−62° C.]. The partially condensed expanded stream 36*a* is thereafter supplied as feed to fractionation tower 19 at a lower mid-column feed point.

The recompressed and cooled distillation stream 38*e* is divided into two streams. One portion, stream 52, is the residue gas product. The other portion, recycle stream 51, flows to heat exchanger 27 where it is cooled to −1° F. [−18° C.] (stream 51*a*) by heat exchange with a portion (stream 49) of cool distillation column overhead stream 38*a* at −15° F. [−26° C.]. The cooled recycle stream then flows to exchanger 22 where it is cooled to −138° F. [−95° C.] and substantially condensed by heat exchange with cold distillation stream 38. The substantially condensed stream 51*b* is then expanded through an appropriate expansion device, such as expansion valve 15, to the demethanizer operating pressure, resulting in cooling of the total stream. In the process illustrated in FIG. 2, the expanded stream 51*c* leaving expansion valve 15 reaches a temperature of −145° F. [−98° C.] and is supplied to the fractionation tower as the top column feed. The vapor portion (if any) of stream 51*c* combines with the vapors rising from the top fractionation stage of the column to form distillation stream 38, which is withdrawn from an upper region of the tower.

The demethanizer in tower 19 is a conventional distillation column containing a plurality of vertically spaced trays, one or more packed beds, or some combination of trays and packing. As is often the case in natural gas processing plants, the fractionation tower may consist of two sections. The upper section 19*a* is a separator wherein the top feed is divided into its respective vapor and liquid portions, and wherein the vapor rising from the lower distillation or demethanizing section 19*b* is combined with the vapor portion (if any) of the top feed to form the cold demethanizer overhead vapor (stream 38) which exits the top of the tower at −142° F. [−97° C.]. The lower, demethanizing section 19*b* contains the trays and/or packing and provides the necessary contact between the liquids falling downward and the vapors rising upward. The demethanizing section 19*b* also includes reboilers (such as trim reboiler 20 and the reboiler and side reboiler described previously) which heat and vaporize a portion of the liquids flowing down the column to provide the stripping vapors which flow up the column to strip the liquid product, stream 41, of methane and lighter components.

The liquid product stream 41 exits the bottom of the tower at 55° F. [13° C.], based on a typical specification of a methane to ethane ratio of 0.025:1 on a molar basis in the bottom product. Pump 21 delivers stream 41*a* to heat exchanger 10 as described previously where it is heated to 116° F. [47° C.] before flowing to storage. The demethanizer overhead vapor stream 38 passes countercurrently to the incoming feed gas and recycle stream in heat exchanger 22 where it is heated to −15° F. [−26° C.]. The heated stream 38*a* is divided into two portions (streams 49 and 48), which are heated to 116° F. [47° C.] and 78° F. [25° C.], respectively, in heat exchanger 27 and heat exchanger 10. The heated streams recombine to form stream 38*b* at 84° F. [29° C.] which is then re-compressed in two stages, compressor 18 driven by expansion machine 17 and compressor 25 driven by a supplemental power source. After stream 38*d* is cooled to 120° F. [49° C.] in discharge cooler 26 to form stream 38*e*, recycle stream 51 is withdrawn as described earlier to form residue gas stream 52 which flows to the sales gas pipeline at 1040 psia [7,171 kPa(a)].

A summary of stream flow rates and energy consumption for the process illustrated in FIG. 2 is set forth in the following table:

TABLE II (FIG. 2)

Stream Flow Summary - Lb. Moles/Hr [kg moles/Hr]

| Stream | Methane | Ethane | Propane | Butanes+ | C. Dioxide | Total |
|---|---|---|---|---|---|---|
| 31 | 25,384 | 1,161 | 362 | 332 | 400 | 27,714 |
| 32 | 25,307 | 1,145 | 348 | 252 | 397 | 27,524 |
| 33 | 77 | 16 | 14 | 80 | 3 | 190 |
| 34 | 7,719 | 349 | 106 | 77 | 121 | 8,395 |
| 36 | 17,588 | 796 | 242 | 175 | 276 | 19,129 |
| 35 | 7,796 | 365 | 120 | 157 | 124 | 8,585 |
| 38 | 29,587 | 40 | 0 | 0 | 146 | 29,859 |
| 51 | 4,231 | 6 | 0 | 0 | 21 | 4,270 |
| 52 | 25,356 | 34 | 0 | 0 | 125 | 25,589 |
| 41 | 28 | 1,127 | 362 | 332 | 275 | 2,125 |

Recoveries*

| | |
|---|---|
| Ethane | 97.04% |
| Propane | 100.00% |
| Butanes+ | 100.00% |

Power

| | | |
|---|---|---|
| Residue Gas Compression | 14,219 HP | [23,376 kW] |

*(Based on un-rounded flow rates)

By modifying the FIG. 1 equipment and piping as shown in FIG. 2, the natural gas processing plant can now achieve 97% recovery of the $C_2$ components in the feed gas. This means that the plant has the flexibility to operate as shown in FIG. 2 and recover essentially all of the $C_2$ components when the value of liquid $C_2$ components is attractive, or to operate as shown in FIG. 1 and reject the $C_2$ components to the plant residue gas when the $C_2$ components are more valuable as gaseous fuel. However, the required modifications require much additional equipment and piping (as shown by the bold lines) and do not make use of much of the equipment present in the FIG. 1 plant (shown by the light dashed lines), so the capital cost of a plant designed to operate using both the FIG. 1 process and the FIG. 2 process will be higher than is desirable. (Note that although the FIG. 2 process can be adapted to reject the $C_2$ components like the FIG. 1 process, the power consumption when operating in this manner is essentially the same as that shown in Table II. Since this is about 11% higher than that of the FIG. 1 process as shown in Table I, the operating cost of a plant using the FIG. 1 process is considerably lower than that of one using the FIG. 2 process in this manner.)

DESCRIPTION OF THE INVENTION

Example 1

Figure 3:
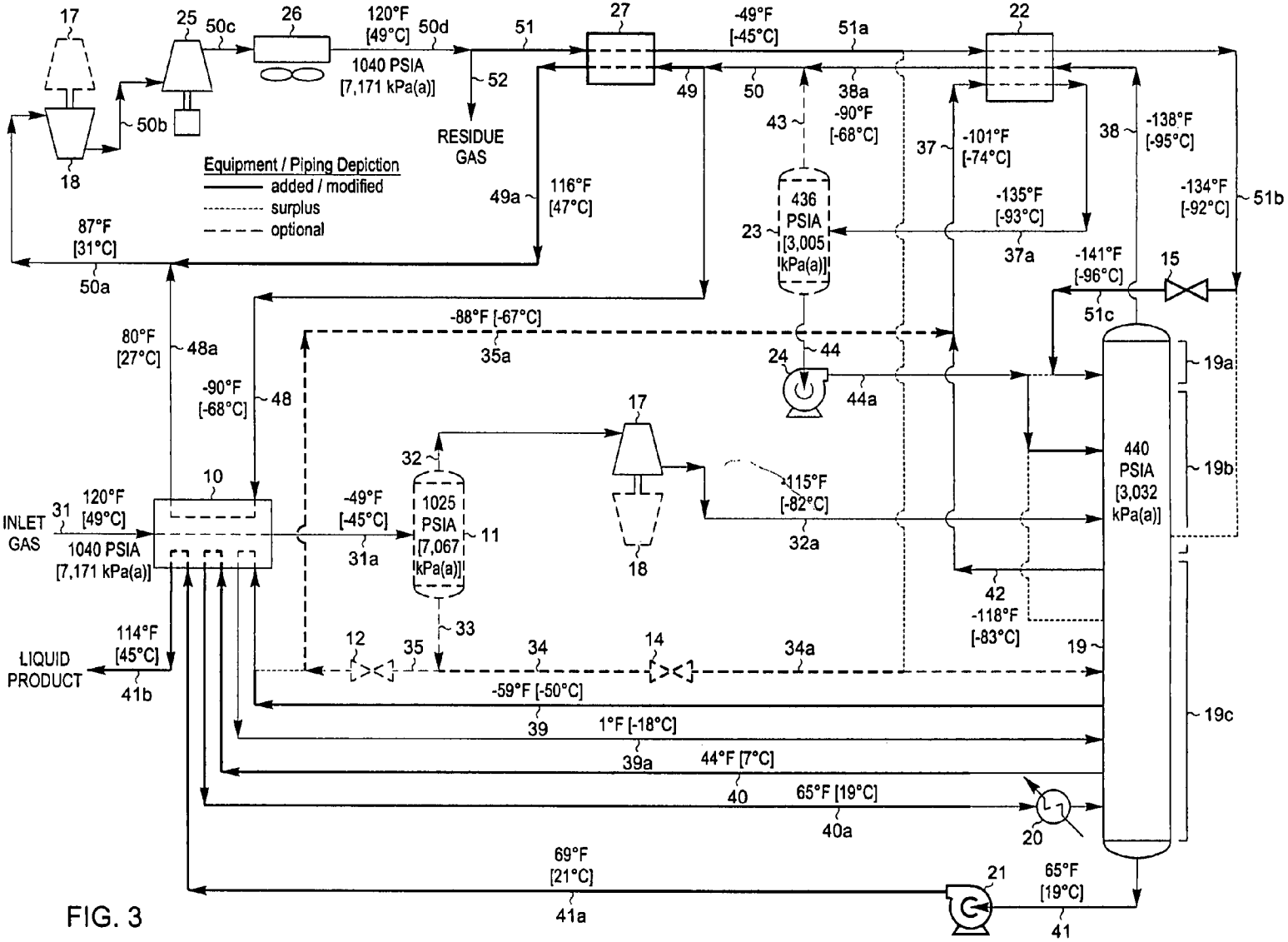
FIG. 3 is a flow diagram of a natural gas processing plant in accordance with the present invention.

FIG. 3 is a process flow diagram illustrating how the design of the processing plant in FIG. 1 can be adapted to operate at a higher $C_2$ component recovery level in accordance with the present invention. The process of FIG. 3 has been applied to the same feed gas composition and conditions as described previously for FIG. 1. However, in the simulation of the process of the present invention as shown in FIG. 3, certain equipment and piping have been added (shown by bold lines) while other equipment and piping have been removed from service (shown by light dashed lines) as noted by the legend on FIG. 3 so that the process operating conditions can be adjusted to increase the recovery of $C_2$ components to about 97%. Since the feed gas composition and conditions considered in the process presented in FIG. 3 are the same as those in FIG. 2, the FIG. 3 process can be compared with that of the FIG. 2 process to illustrate the advantages of the present invention.

In the simulation of the FIG. 3 process, inlet gas enters the plant as stream 31 and is cooled in heat exchanger 10 by heat exchange with a portion (stream 48) of cool distillation stream 50 at −90° F. [−68° C.], demethanizer liquids (stream 39) at −59° F. [−50° C.], demethanizer liquids (stream 40) at 44° F. [7° C.], and the pumped demethanizer bottoms liquid (stream 41*a*) at 69° F. [21° C.]. The cooled stream 31*a* enters separator 11 at −49° F. [−45° C.] and 1025 psia [7,067 kPa(a)] where the vapor (stream 32) is separated from the condensed liquid (stream 33).

The separator vapor (stream 32) enters a work expansion machine 17 in which mechanical energy is extracted from this portion of the high pressure feed. The machine 17 expands the vapor substantially isentropically to the tower operating pressure of 440 psia [3,032 kPa(a)], with the work expansion cooling the expanded stream 32*a* to a temperature of approximately −115° F. [−82° C.]. The partially condensed expanded stream 32*a* is thereafter supplied as feed to fractionation tower 19 at a lower mid-column feed point.

The recompressed and cooled distillation stream 50*d* is divided into two streams. One portion, stream 52, is the residue gas product. The other portion, recycle stream 51, flows to heat exchanger 27 where it is cooled to −49° F. [−45° C.] (stream 51*a*) by heat exchange with a portion (stream 49) of cool distillation stream 50 at −90° F. [−68° C.]. The cooled recycle stream then flows to exchanger 22 where it is cooled to −134° F. [−92° C.] and substantially condensed by heat exchange with cold distillation column overhead stream 38. The substantially condensed stream 51*b* is then expanded through an appropriate expansion device, such as expansion valve 15, to the demethanizer operating pressure, resulting in cooling of the total stream. In the process illustrated in FIG. 3, the expanded stream 51*c* leaving expansion valve 15 reaches a temperature of −141° F. [−96° C.] and is supplied to the fractionation tower as the top column feed. The vapor portion (if any) of stream 51*c* combines with the vapors rising from the top fractionation stage of the column to form distillation stream 38, which is withdrawn from an upper region of the tower.

The demethanizer in tower 19 is a conventional distillation column containing a plurality of vertically spaced trays, one or more packed beds, or some combination of trays and packing. The demethanizer tower consists of three sections: an upper separator section 19*a* wherein the top feed is divided into its respective vapor and liquid portions, and wherein the vapor rising from the intermediate absorbing section 19*b* is combined with the vapor portion (if any) of the top feed to form the cold demethanizer overhead vapor (stream 38); an intermediate absorbing (rectification) section 19*b* that contains the trays and/or packing to provide the necessary contact between the vapor portion of the expanded stream 32*a* rising upward and cold liquid falling downward to condense and absorb the $C_2$ components, $C_3$ components, and heavier components; and a lower, stripping section 19*c* that contains the trays and/or packing to provide the necessary contact between the liquids falling downward and the vapors rising upward. The demethanizing section 19*c* also includes reboilers (such as trim reboiler 20 and the reboiler and side reboiler described previously) which heat and vaporize a portion of the liquids flowing down the column to provide the stripping vapors which flow up the column to strip the liquid product, stream 41, of methane and lighter components.

Stream 32*a* enters demethanizer 19 at an intermediate feed position located in the lower region of absorbing section 19*b* of demethanizer 19. The liquid portion of expanded stream 32*a* commingles with liquids falling downward from the absorbing section 19*b* and the combined liquid continues downward into the stripping section 19*c* of demethanizer 19. The vapor portion of expanded stream 32*a* rises upward through absorbing section 19*b* and is contacted with cold liquid falling downward to condense and absorb the $C_2$ components, $C_3$ components, and heavier components.

The separator liquid (stream 33) may be divided into two portions (stream 34 and stream 35). The first portion (stream 34), which may be from 0% to 100%, is expanded to the operating pressure of fractionation tower 19 by expansion valve 14 and the expanded stream 34*a* is supplied to fractionation tower 19 at a second lower mid-column feed point. Any remaining portion (stream 35), which may be from 100% to 0%, is expanded to the operating pressure of fractionation tower 19 by expansion valve 12, cooling it to −88° F. [−67° C.] (stream 35*a*). A portion of the distillation vapor (stream 42) is withdrawn from the upper region of stripping section 19*c* at −118° F. [−83° C.] and combined with stream 35*a*. The combined stream 37 is then cooled from −101° F. [−74° C.] to −135° F. [−93° C.] and condensed (stream 37*a*) by heat exchange with the cold demethanizer overhead stream 38 exiting the top of demethanizer 19 at −138° F. [−95° C.]. The cold demethanizer overhead stream is heated to −90° F. [−68° C.](stream 38*a*) as it cools and condenses streams 37 and 51*a*. Note that in all cases exchangers 10, 22, and 27 are representative of either a multitude of individual heat exchangers or a single multi-pass heat exchanger, or any combination thereof. (The decision as to whether to use more than one heat exchanger for the indicated heating services will depend on a number of factors including, but not limited to, inlet gas flow rate, heat exchanger size, stream temperatures, etc.)

The operating pressure in reflux separator 23 (436 psia [3,005 kPa(a)]) is maintained slightly below the operating pressure of demethanizer 19. This provides the driving force which allows distillation vapor stream 42 to combine with stream 35*a* and the combined stream 37 to flow through heat exchanger 22 and thence into the reflux separator 23. Any uncondensed vapor (stream 43) is separated from the condensed liquid (stream 44) in reflux separator 23 and then combined with the heated demethanizer overhead stream 38*a* from heat exchanger 22 to form cool distillation vapor stream 50 at −90° F. [−68° C.].

The liquid stream 44 from reflux separator 23 is pumped by pump 24 to a pressure slightly above the operating pressure of demethanizer 19, and the resulting stream 44*a* is then supplied as cold liquid reflux to an intermediate region in absorbing section 19*b* of demethanizer 19. This supplemental reflux absorbs and condenses most of the $C_3$ components and heavier components (as well as some of the $C_2$ components) from the vapors rising in the lower rectification region of absorbing section 19*b* so that only a small amount of recycle (stream 51) must be cooled, condensed, subcooled, and flash expanded to produce the top reflux stream 51*c* that provides the final rectification in the upper region of absorbing section 19*b*. As the cold reflux stream 51*c* contacts the rising vapors in the upper region of absorbing section 19*b*, it condenses and absorbs the $C_2$ components and any remaining $C_3$ components and heavier components from the vapors so that they can be captured in the bottom product (stream 41) from demethanizer 19.

In stripping section 19*c* of demethanizer 19, the feed streams are stripped of their methane and lighter components. The resulting liquid product (stream 41) exits the bottom of tower 19 at 65° F. [19° C.], based on a typical specification of a methane to ethane ratio of 0.025:1 on a molar basis in the bottom product. Pump 21 delivers stream 41*a* to heat exchanger 10 as described previously where it is heated to 114° F. [45° C.] before flowing to storage.

The distillation vapor stream forming the tower overhead (stream 38) is warmed in heat exchanger 22 as it provides cooling to combined stream 37 and recycle stream 51*a* as described previously, then combines with any uncondensed vapor in stream 43 to form cool distillation stream 50. Distillation stream 50 is divided into two portions (streams 49 and 48), which are heated to 116° F. [47° C.] and 80° F. [27° C.], respectively, in heat exchange exchanger 10. The heated streams recombine to form stream 50*a* at 87° F. [31° C.] which is then re-compressed in two stages, compressor 18 driven by expansion machine 17 and compressor 25 driven by a supplemental power source. After stream 50*c* is cooled to 120° F. [49° C.] in discharge cooler 26 to form stream 50*d*, recycle stream 51 is withdrawn as described earlier to form residue gas stream 52 which flows to the sales gas pipeline at 1040 psia [7,171 kPa(a)].

A summary of stream flow rates and energy consumption for the process illustrated in FIG. 3 is set forth in the following table:

TABLE III (FIG. 3)

Stream Flow Summary - Lb. Moles/Hr [kg moles/Hr]

| Stream | Methane | Ethane | Propane | Butanes+ | C. Dioxide | Total |
|---|---|---|---|---|---|---|
| 31 | 25,384 | 1,161 | 362 | 332 | 400 | 27,714 |
| 32 | 24,823 | 1,066 | 293 | 163 | 380 | 26,800 |
| 33 | 561 | 95 | 69 | 169 | 20 | 914 |
| 34 | 0 | 0 | 0 | 0 | 0 | 0 |
| 35 | 561 | 95 | 69 | 169 | 20 | 914 |
| 42 | 2,025 | 44 | 3 | 0 | 26 | 2,100 |
| 37 | 2,586 | 139 | 72 | 169 | 46 | 3,014 |
| 43 | 0 | 0 | 0 | 0 | 0 | 0 |
| 44 | 2,586 | 139 | 72 | 169 | 46 | 3,014 |
| 38 | 31,498 | 42 | 0 | 0 | 216 | 31,850 |
| 50 | 31,498 | 42 | 0 | 0 | 216 | 31,850 |
| 51 | 6,142 | 8 | 0 | 0 | 42 | 6,211 |

TABLE III-continued

| (FIG. 3) | | | | | | |
|---|---|---|---|---|---|---|
| 52 | 25,356 | 34 | 0 | 0 | 174 | 25,639 |
| 41 | 28 | 1,127 | 362 | 332 | 226 | 2,075 |

| Recoveries* | |
|---|---|
| Ethane | 97.05% |
| Propane | 100.00% |
| Butanes+ | 100.00% |

| Power | | |
|---|---|---|
| Residue Gas Compression | 14,303 HP | [23,514 kW] |

*(Based on un-rounded flow rates)

A comparison of Tables II and III shows that, compared to the base case, the present invention maintains essentially the same ethane recovery (97.05% versus 97.04%), propane recovery (100.00% versus 100.00%), and butanes+recovery (100.00% versus 100.00%). Comparison of Tables II and III further shows that these yields were achieved using essentially the same horsepower requirements.

However, a comparison of FIG. 2 and FIG. 3 shows that the present invention as depicted in FIG. 3 makes much more effective use of the equipment and piping for the FIG. 1 process than the process depicted in FIG. 2 does. The following Tables IV and V compare the changes needed to convert the natural gas processing plant depicted in FIG. 1 to use either the process depicted in FIG. 2 or the process of the present invention as depicted in FIG. 3. Table IV shows the equipment and piping that must be added to or modified in the FIG. 1 process to convert it, and Table V shows the equipment and piping in the FIG. 1 process that become surplus when it is converted.

TABLE IV

Comparison of FIG. 2 and FIG. 3

| Additional/Modified Equipment and Piping | FIG. 2 | FIG. 3 |
|---|---|---|
| Additional passes in heat exchanger 10 | yes | yes |
| Flash expansion valve 14 | no | maybe |
| Flash expansion valve 15 | yes | yes |
| Flash expansion valve 16 | yes | no |
| Additional feed point and rectification section for column 19 | yes | yes |
| Demethanizer bottoms pump 21 | yes | yes |
| First cooling pass in heat exchanger 22 designed for high pressure | yes | no |
| Second cooling pass in heat exchanger 22 | yes | yes |
| Heat exchanger 27 | yes | yes |
| Column liquid draw piping for stream 39 | yes | yes |
| Column liquid draw and return piping for streams 40 and 40a | yes | yes |
| Liquid piping for streams 41a and 41b | yes | yes |
| Gas piping for streams 49 and 49a | yes | yes |
| Liquid piping for stream 51c | yes | yes |
| Gas/liquid piping for streams 34 and 35 (as depicted in FIG. 2) | yes | no |
| Liquid piping for streams 34 and 34a (as depicted in FIG. 3) | no | maybe |
| Liquid piping for stream 35a (as depicted in FIG. 3) | no | maybe |

TABLE V

Comparison of FIG. 2 and FIG. 3

| Surplus Equipment and Piping | FIG. 2 | FIG. 3 |
|---|---|---|
| Flash expansion valve 12 | yes | no |
| Reflux drum 23 | yes | no |
| Reflux pump 24 | yes | no |
| Liquid piping for upper reflux from stream 44a | yes | no |
| Liquid piping for lower reflux from stream 44a | yes | yes |
| Vapor piping for vapor distillation stream 42 | yes | no |
| Liquid piping for liquid distillation streams 47 and 47a | yes | yes |

As Table IV shows, the present invention as depicted in FIG. 3 requires fewer changes to the equipment and piping of the FIG. 1 process to adapt it for high $C_2$ component recovery levels compared to the process of FIG. 2. Further, as Table V shows, nearly all of the equipment and piping of the FIG. 1 process can remain in service when the present invention is applied as shown in FIG. 3, making more effective use of the capital investment already required for the FIG. 1 gas processing plant. Thus, the present invention provides a very economical means for constructing a gas processing plant that can adjust its recovery level to adapt to changes in the plant economics. When the value of $C_2$ components as a liquid is high, the present invention can be operated as depicted in FIG. 3 to efficiently recover essentially all of the $C_2$ components (plus the $C_3$ components and heavier components) present in the feed gas. When the $C_2$ components have greater value as gaseous fuel, the same plant can be operated using the prior art process depicted in FIG. 1 to efficiently reject all of the $C_2$ components to the residue gas while recovering essentially all of the $C_3$ components and heavier components in the column bottom product. Although the process depicted in FIG. 2 can accomplish this same flexibility, the capital cost of a gas processing plant capable of operating as shown in both FIGS. 1 and 2 is higher than a plant that can operate as shown in both FIGS. 1 and 3.

The key feature of the present invention is the supplemental rectification provided by reflux stream 44*a*, which reduces the amount of $C_3$ components and $C_4$+ components contained in the vapors rising in the upper region of absorbing section 19*b*. Although the flow rate of reflux stream 44*a* in FIG. 3 is less than half of the flow rate of stream 35*b* in FIG. 2, its mass is sufficient to provide bulk recovery of the $C_3$ components and heavier hydrocarbon components contained in expanded feed 32*a* and the vapors rising from stripping section 19*c*. Consequently, the quantity of liquid methane reflux (stream 51*c*) that must be supplied to the upper rectification section in absorbing section 19*b* to capture nearly all of the $C_2$ components is only about 45% higher than the flow rate of stream 51*c* in FIG. 2, and is still small enough that the cold demethanizer overhead vapor (stream 38) can provide the refrigeration needed to generate both this reflux and the reflux in stream 44*a*. As a result, nearly 100% of the $C_2$ components and substantially all of the heavier hydrocarbon components are recovered in liquid product 41 leaving the bottom of demethanizer 19 without requiring the additional equipment and piping needed to produce stream 35*b* in FIG. 2 to accomplish the same result.

Figure 4:
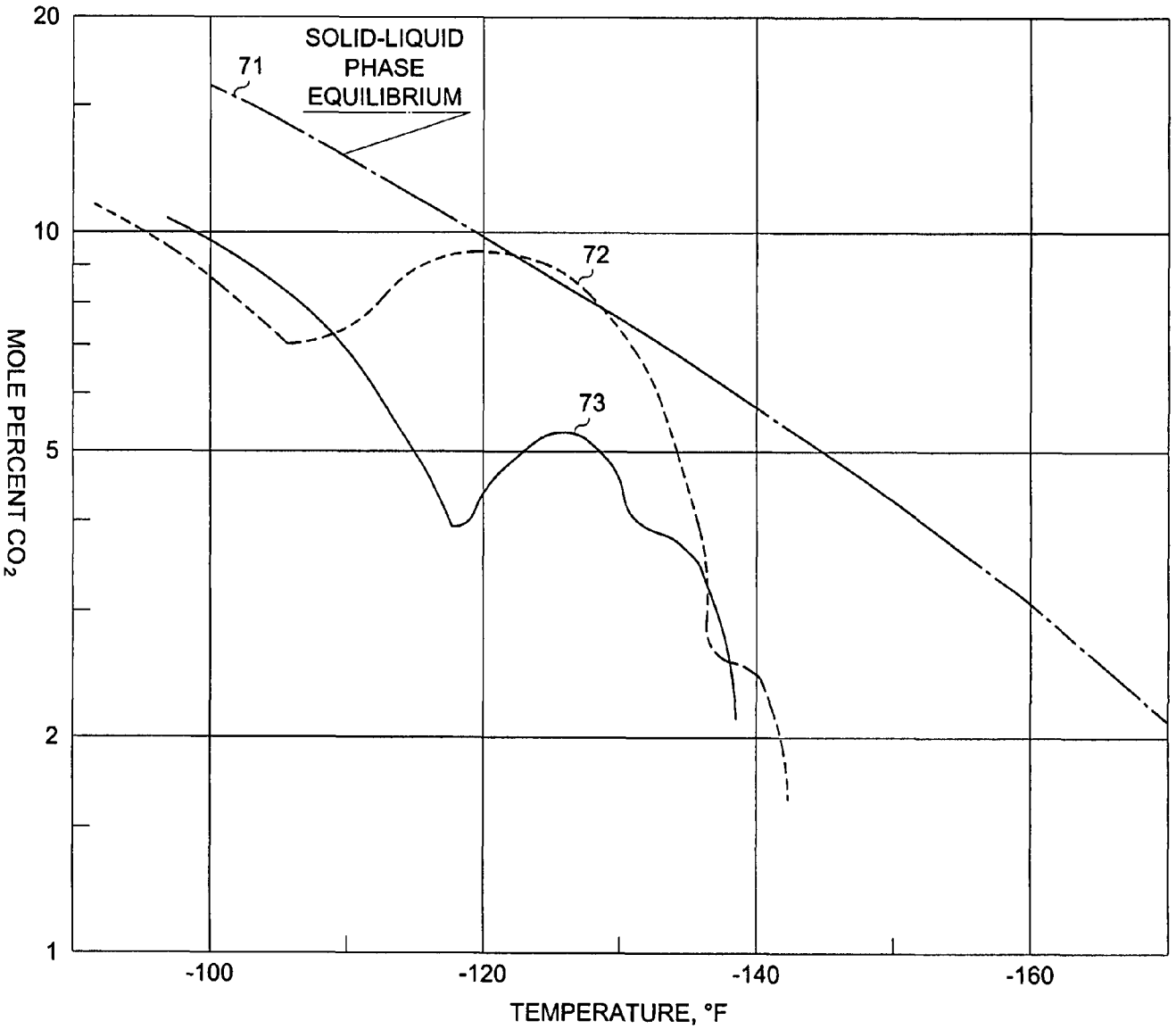
FIG. 4 is a concentration-temperature diagram for carbon dioxide showing the effect of the present invention.

A further advantage of the present invention is a reduced likelihood of carbon dioxide icing. FIG. 4 is a graph of the relation between carbon dioxide concentration and temperature. Line 71 represents the equilibrium conditions for solid and liquid carbon dioxide in methane. (The liquid-solid equilibrium line in this graph is based on the data given in FIG. 16-33 on page 16-24 of the *Engineering Data Book*, Twelfth Edition, published in 2004 by the Gas Processors Suppliers Association.) A liquid temperature on or to the right of line 71, or a carbon dioxide concentration on or above this line, signifies an icing condition. Because of the variations which normally occur in gas processing facilities (e.g., feed gas composition, conditions, and flow rate), it is usually desired to design a demethanizer with a considerable safety factor between the expected operating conditions and the icing conditions. (Experience has shown that the conditions of the liquids on the fractionation stages of a demethanizer, rather than the conditions of the vapors, govern the allowable operating conditions in most demethanizers. For this reason, the corresponding vapor-solid equilibrium line is not shown in FIG. 4.)

Also plotted in FIG. 4 is a line representing the conditions for the liquids on the fractionation stages of demethanizer 19 in the FIG. 2 process (line 72). As can be seen, a portion of this operating line lies above the liquid-solid equilibrium line, indicating that the FIG. 2 process cannot be operated at these conditions without encountering carbon dioxide icing problems. As a result, it is not possible to use the FIG. 2 process under these conditions, so the FIG. 2 process cannot actually achieve the recovery efficiencies stated in Table II in practice without removal of at least some of the carbon dioxide from the feed gas. This would, of course, substantially increase capital cost.

Line 73 in FIG. 4 represents the conditions for the liquids on the fractionation stages of demethanizer 19 in the present invention as depicted in FIG. 3. In contrast to the FIG. 2 process, there is a minimum safety factor of 1.52 between the anticipated operating conditions and the icing conditions for the FIG. 3 process. That is, it would require a 51 percent increase in the carbon dioxide content of the liquids to cause icing. Thus, the present invention could tolerate a 51% higher concentration of carbon dioxide in its feed gas than the FIG. 2 process could tolerate without risk of icing. Further, whereas the FIG. 2 process cannot be operated to achieve the recovery levels given in Table II because of icing, the present invention could in fact be operated at even higher recovery levels than those given in Table III without risk of icing.

The shift in the operating conditions of the FIG. 3 demethanizer as indicated by line 73 in FIG. 4 can be understood by comparing the distinguishing features of the present invention to the process of FIG. 2. While the shape of the operating line for the FIG. 2 process (line 72) is similar to the shape of the operating line for the present invention (line 73), there are two key differences. One difference is that the operating temperatures of the critical upper fractionation stages in the demethanizer in the FIG. 3 process are warmer than those of the corresponding fractionation stages in the demethanizer in the FIG. 2 process, effectively shifting the operating line of the FIG. 3 process away from the liquid-solid equilibrium line. The warmer temperatures of the fractionation stages in the FIG. 3 demethanizer are partly the result of operating the tower at higher pressure than the FIG. 2 process. However, the higher tower pressure does not cause a loss in $C_2$+ component recovery levels because the recycle stream 51 in the FIG. 3 process is in essence an open direct-contact compression-refrigeration cycle for the demethanizer using a portion of the volatile residue gas as the working fluid, supplying needed refrigeration to the process to overcome the loss in recovery that normally accompanies an increase in demethanizer operating pressure.

The more significant difference between the two operating lines in FIG. 4, however, is the much lower concentrations of carbon dioxide in the liquids on the fractionation stages of demethanizer 19 in the FIG. 3 process compared to those of demethanizer 19 in the FIG. 2 process. One of the inherent features in the operation of a demethanizer column to recover $C_2$ components is that the column must fractionate between the methane that is to leave the tower in its overhead product (vapor stream 38) and the $C_2$ components that are to leave the tower in its bottom product (liquid stream 41). However, the relative volatility of carbon dioxide lies between that of methane and $C_2$ components, causing the carbon dioxide to appear in both terminal streams. Further, carbon dioxide and ethane form an azeotrope, resulting in a tendency for carbon dioxide to accumulate in the intermediate fractionation stages of the column and thereby cause large concentrations of carbon dioxide to develop in the tower liquids.

It is well known that adding a third component is often an effective means for "breaking" an azeotrope. As noted in U.S. Pat. No. 4,318,723, $C_3$-$C_6$ alkane hydrocarbons, particularly n-butane, are effective in modifying the behavior of carbon dioxide in hydrocarbon mixtures. Experience has shown that the composition of the upper mid-column feed (i.e., stream 35*b* in FIG. 2 or stream 44*a* in FIG. 3) to demethanizers of this type has significant impact on the composition of the liquids on the crucial fractionation stages in the upper section of the demethanizer. Comparing these two streams in Table II and Table III, note that the $C_3$+ and $C_4$+ component concentrations for the FIG. 2 process are 3.2% and 1.8%, respectively, versus 8.0% and 5.6%, respectively, for the FIG. 3 process. Thus, the concentrations of $C_3$+ components and $C_4$+ components for the upper mid-column feed of the present invention shown in FIG. 3 are 2-3 times higher than those of the process in FIG. 2. The net impact of this is to "break" the azeotrope and reduce the carbon dioxide concentrations in the column liquids accordingly. A further impact of the higher concentrations of $C_4$+ components in the liquids on the fractionation stages of demethanizer 19 in the FIG. 3 process is to raise the bubble point temperatures of the tray liquids, adding to the favorable shift of operating line 73 for the FIG. 3 process away from the liquid-solid equilibrium line in FIG. 4.

Example 2

Figure 5:
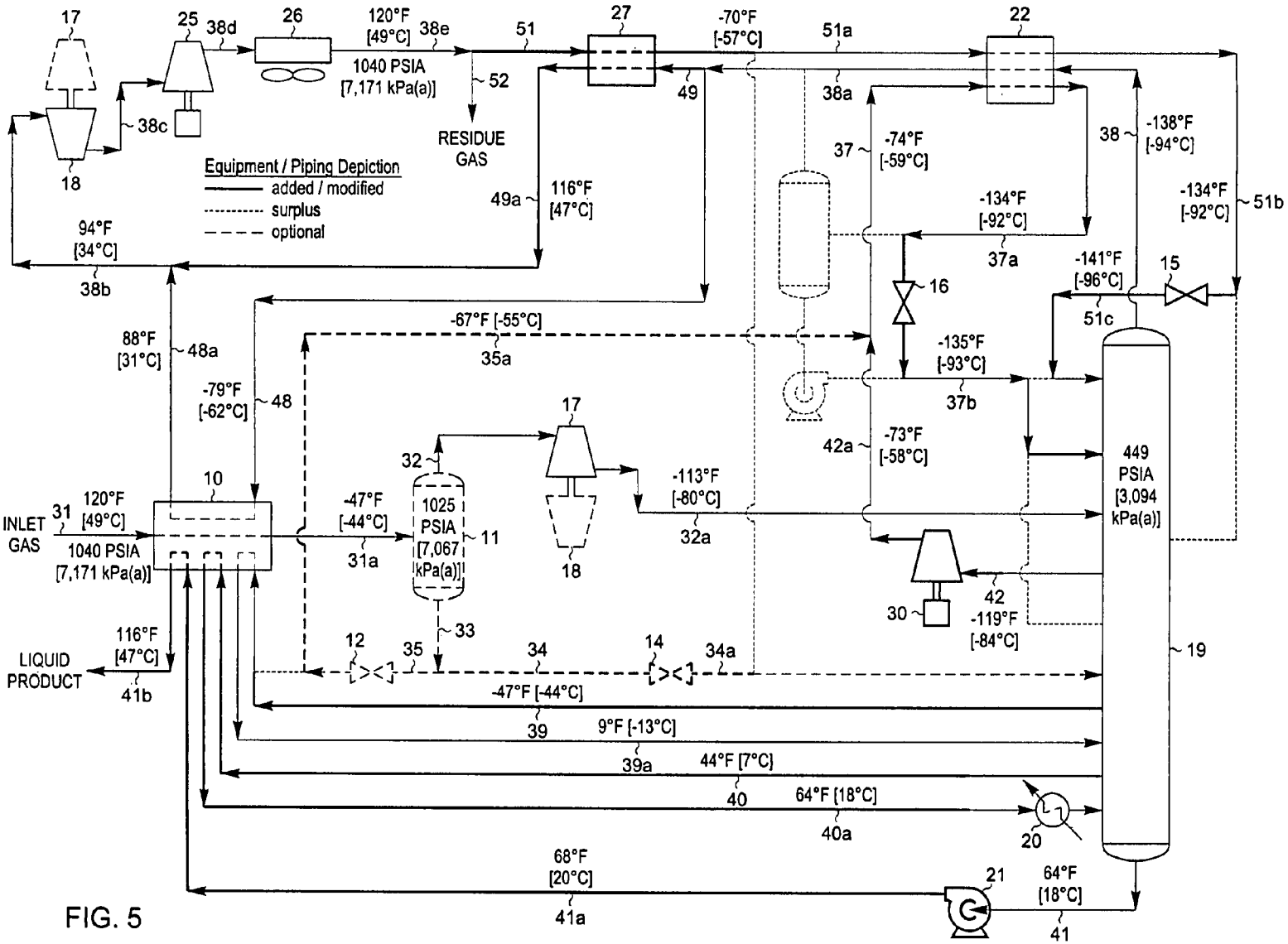
FIG. 5 is a flow diagram illustrating an alternative means of application of the present invention to a natural gas stream.

FIG. 3 represents the preferred embodiment of the present invention for the temperature and pressure conditions shown because it typically requires the least equipment and the lowest capital investment. An alternative method of producing the supplemental reflux stream for the column is shown in another embodiment of the present invention as illustrated in FIG. 5. The feed gas composition and conditions considered in the process presented in FIG. 5 are the same as those in FIGS. 1 through 3. Accordingly, FIG. 5 can be compared with the FIG. 2 process to illustrate the advantages of the present invention, and can likewise be compared to the embodiment displayed in FIG. 3.

In the simulation of the FIG. 5 process, inlet gas enters the plant as stream 31 and is cooled in heat exchanger 10 by heat exchange with a portion (stream 48) of cool distillation stream 38*a* at −79° F. [−62° C.], demethanizer liquids (stream 39) at −47° F. [−44° C.], demethanizer liquids (stream 40) at 44° F. [7° C.], and the pumped demethanizer bottoms liquid (stream 41*a*) at 68° F. [20° C.]. The cooled stream 31*a* enters separator 11 at −47° F. [−44° C.] and 1025 psia [7,067 kPa(a)] where the vapor (stream 32) is separated from the condensed liquid (stream 33).

The separator vapor (stream 32) enters a work expansion machine 17 in which mechanical energy is extracted from this portion of the high pressure feed. The machine 17 expands the vapor substantially isentropically to the tower operating pressure of 449 psia [3,094 kPa(a)], with the work expansion cooling the expanded stream 32*a* to a temperature of approximately −113° F. [−80° C.]. The partially condensed expanded stream 32*a* is thereafter supplied as feed to fractionation tower 19 at a lower mid-column feed point. The separator liquid (stream 33) may be divided into two portions (stream 34 and stream 35). The first portion (stream 34), which may be from 0% to 100%, is expanded to the operating pressure of fractionation tower 19 by expansion valve 14 and the expanded stream 34*a* is supplied to fractionation tower 19 at a second lower mid-column feed point.

The recompressed and cooled distillation stream 38*e* is divided into two streams. One portion, stream 52, is the residue gas product. The other portion, recycle stream 51, flows to heat exchanger 27 where it is cooled to −70° F. [−57° C.] (stream 51*a*) by heat exchange with a portion (stream 49) of cool distillation stream 38*a* at −79° F. [−62° C.]. The cooled recycle stream then flows to exchanger 22 where it is cooled to −134° F. [−92° C.] and substantially condensed by heat exchange with cold distillation column overhead stream 38. The substantially condensed stream 51*b* is then expanded through an appropriate expansion device, such as expansion valve 15, to the demethanizer operating pressure, resulting in cooling of the total stream. In the process illustrated in FIG. 5, the expanded stream 51*c* leaving expansion valve 15 reaches a temperature of −141° F. [−96° C.] and is supplied to the fractionation tower as the top column feed. The vapor portion (if any) of stream 51*c* combines with the vapors rising from the top fractionation stage of the column to form distillation stream 38, which is withdrawn from an upper region of the tower.

A portion of the distillation vapor (stream 42) is withdrawn from the upper region of the stripping section of demethanizer 19 at −119° F. [−84° C.] and compressed by compressor 30 (stream 42*a*) to 668 psia [4,604 kPa(a)]. The remaining portion of separator liquid stream 33 (stream 35), which may be from 100% to 0%, is expanded to this pressure by expansion valve 12, cooling it to −67° F. [−55° C.] before stream 35*a* is combined with stream 42*a*. The combined stream 37 is then cooled from −74° F. [−59° C.] to −134° F. [−92° C.] and condensed (stream 37*a*) in heat exchanger 22 by heat exchange with the cold demethanizer overhead stream 38 exiting the top of demethanizer 19 at −138° F. [−94° C.]. The condensed stream 37*a* is then expanded by expansion valve 16 to the operating pressure of demethanizer 19, and the resulting stream 37*b* at −135° F. [−93° C.] is then supplied as cold liquid reflux to an intermediate region in the absorbing section of demethanizer 19. This supplemental reflux absorbs and condenses most of the $C_3$ components and heavier components (as well as some of the $C_2$ components) from the vapors rising in the lower rectification region of the absorbing section so that only a small amount of recycle (stream 51) must be cooled, condensed, subcooled, and flash expanded to produce the top reflux stream 51*c* that provides the final rectification in the upper region of the absorbing section.

In the stripping section of demethanizer 19, the feed streams are stripped of their methane and lighter components. The resulting liquid product (stream 41) exits the bottom of tower 19 at 64° F. [18° C.]. Pump 21 delivers stream 41*a* to heat exchanger 10 as described previously where it is heated to 116° F. [47° C.] before flowing to storage.

The distillation vapor stream forming the tower overhead (stream 38) is warmed in heat exchanger 22 as it provides cooling to combined stream 37 and recycle stream 51*a* as described previously. Stream 38*a* is then divided into two portions (streams 49 and 48), which are heated to 116° F. [47° C.] and 80° F. [31° C.], respectively, in heat exchanger exchanger 10. The heated streams recombine to form stream 38*b* at 94° F. [34° C.] which is then re-compressed in two stages, compressor 18 driven by expansion machine 17 and compressor 25 driven by a supplemental power source. After stream 38*d* is cooled to 120° F. [49° C.] in discharge cooler 26 to form stream 38*e*, recycle stream 51 is withdrawn as described earlier to form residue gas stream 52 which flows to the sales gas pipeline at 1040 psia [7,171 kPa(a)].

A summary of stream flow rates and energy consumption for the process illustrated in FIG. 5 is set forth in the following table:

TABLE VI (FIG. 5)

Stream Flow Summary - Lb. Moles/Hr [kg moles/Hr]

| Stream | Methane | Ethane | Propane | Butanes+ | C. Dioxide | Total |
|---|---|---|---|---|---|---|
| 31 | 25,384 | 1,161 | 362 | 332 | 400 | 27,714 |
| 32 | 24,870 | 1,072 | 296 | 166 | 382 | 26,860 |
| 33 | 514 | 89 | 66 | 166 | 18 | 854 |
| 34 | 0 | 0 | 0 | 0 | 0 | 0 |
| 35 | 514 | 89 | 66 | 166 | 18 | 854 |
| 42 | 5,118 | 101 | 5 | 1 | 70 | 5,300 |
| 37 | 5,632 | 190 | 71 | 167 | 88 | 6,154 |
| 38 | 29,831 | 41 | 0 | 0 | 149 | 31,107 |
| 51 | 4,475 | 6 | 0 | 0 | 22 | 4,516 |
| 52 | 25,356 | 35 | 0 | 0 | 127 | 25,591 |
| 41 | 28 | 1,126 | 362 | 332 | 273 | 2,123 |

Recoveries*

| | |
|---|---|
| Ethane | 97.01% |
| Propane | 99.99% |
| Butanes+ | 100.00% |

Power

| | | |
|---|---|---|
| Residue Gas Compression | 13,161 HP | [21,637 kW] |
| Reflux Compression | 522 HP | [858 kW] |
| Total Compression | 13,683 HP | [22,495 kW] |

*(Based on un-rounded flow rates)

A comparison of Tables III and VI shows that, compared to the FIG. 3 embodiment of the present invention, the FIG. 5 embodiment maintains essentially the same ethane recovery (97.01% versus 97.05%), propane recovery (99.99% versus 100.00%), and butanes+recovery (100.00% versus 100.00%). However, comparison of Tables III and VI further shows that these yields were achieved using about 4% less horsepower than that required by the FIG. 3 embodiment. The drop in the power requirements for the FIG. 5 embodiment is mainly due to the lower flow rate of recycle stream 51 compared to that needed with the FIG. 3 embodiment to maintain the same recovery levels. Using compressor 30 in the FIG. 5 embodiment makes it easier to condense combined stream 37 (due to the elevation in pressure), so that a higher flow rate of supplemental reflux stream 37*b* can be used and the flow rate of recycle stream 51 reduced accordingly.

Figure 6:
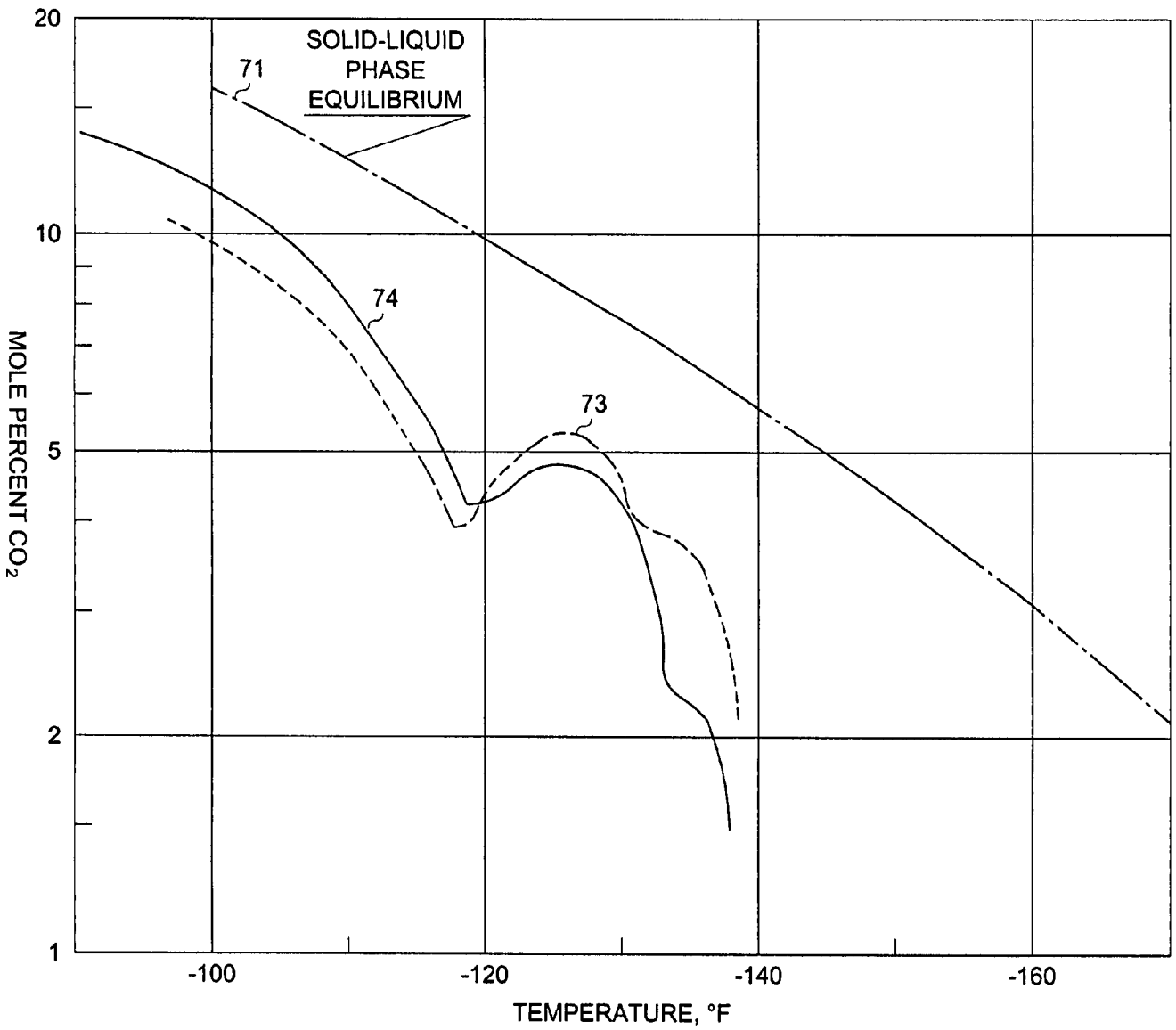
FIG. 6 is a concentration-temperature diagram for carbon dioxide showing the effect of the present invention with respect to the process of FIG. 5.

When the present invention is employed as in Example 2 using a compressor to allow increasing the flow rate of the supplemental reflux stream, the advantage with regard to avoiding carbon dioxide icing conditions is further enhanced compared to the FIG. 3 embodiment. FIG. 6 is another graph of the relation between carbon dioxide concentration and temperature, with line 71 as before representing the equilibrium conditions for solid and liquid carbon dioxide in methane. Line 74 in FIG. 6 represents the conditions for the liquids on the fractionation stages of demethanizer 19 in the present invention as depicted in FIG. 5, and shows a safety factor of 1.64 between the anticipated operating conditions and the icing conditions for the FIG. 5 process. Thus, this embodiment of the present invention could tolerate an increase of 64 percent in the concentration of carbon dioxide without risk of icing. In practice, this improvement in the icing safety factor could be used to advantage by operating the demethanizer at lower pressure (i.e., with colder temperatures on the fractionation stages) to raise the $C_2$+ component recovery levels without encountering icing problems. The shape of line 74 in FIG. 6 is very similar to that of line 73 in FIG. 4 (which is shown for reference in FIG. 6). The primary difference is the significantly lower carbon dioxide concentrations of the liquids on the fractionation stages in the critical upper section of the FIG. 5 demethanizer due to the higher flow rate of upper mid-column feed to the column that is possible with this embodiment.

Other Embodiments

In accordance with this invention, it is generally advantageous to design the absorbing (rectification) section of the demethanizer to contain multiple theoretical separation stages. However, the benefits of the present invention can be achieved with as few as one theoretical stage, and it is believed that even the equivalent of a fractional theoretical stage may allow achieving these benefits. For instance, all or a part of the expanded substantially condensed recycle stream 51*c* from expansion valve 15, all or a part of the supplemental reflux (stream 44*a* in FIG. 3 or stream 37*b* in FIG. 5), and all or a part of the expanded stream 32*a* from work expansion machine 17 can be combined (such as in the piping joining the expansion valve to the demethanizer) and if thoroughly intermingled, the vapors and liquids will mix together and separate in accordance with the relative volatilities of the various components of the total combined streams. Such commingling of the three streams shall be considered for the purposes of this invention as constituting an absorbing section.

Figure 7:
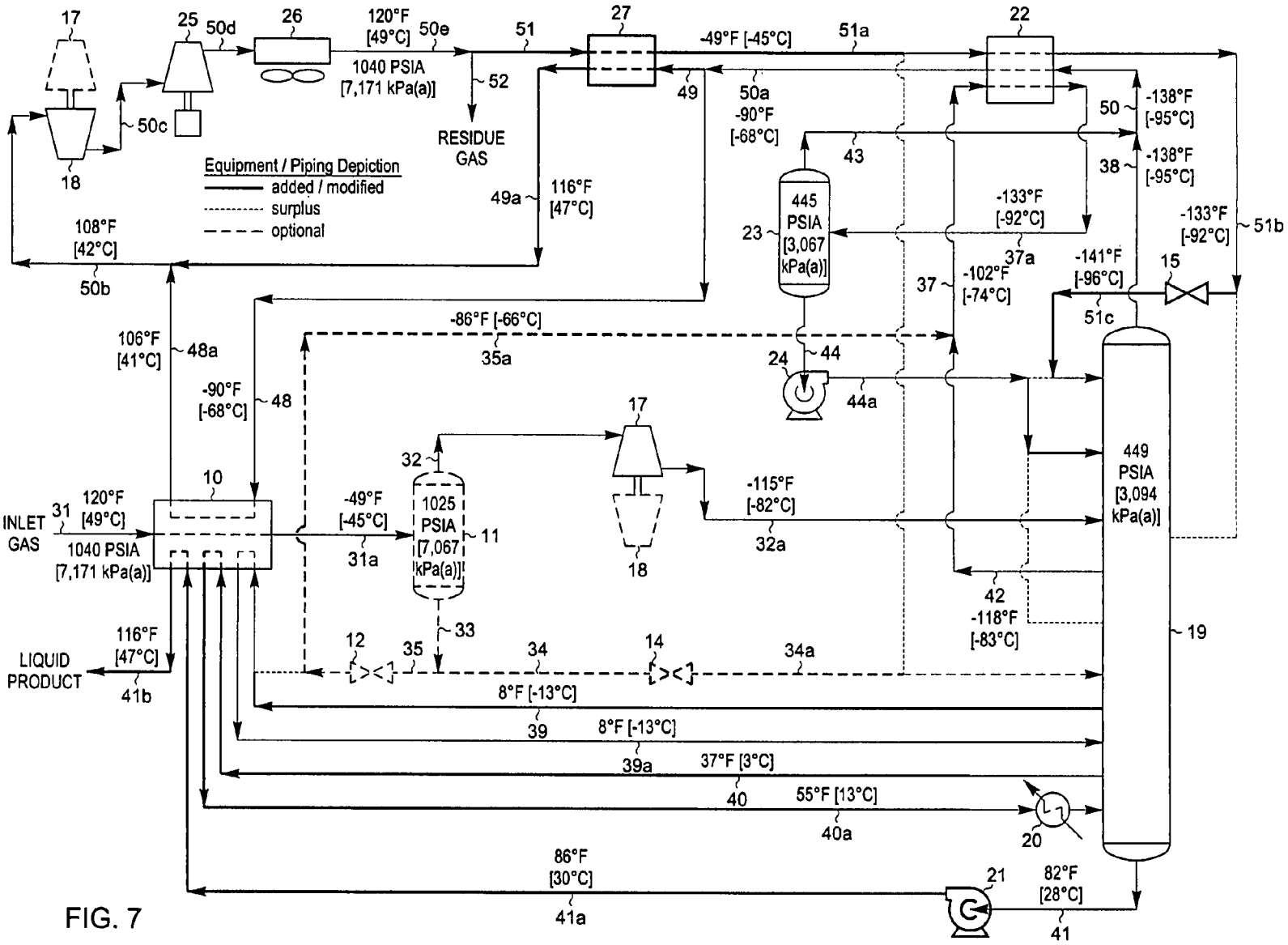
FIGS. 7 through 10 are flow diagrams illustrating alternative means of application of the present invention to a natural gas stream.

Some circumstances may favor mixing any remaining vapor portion of combined stream 37*a* with the fractionation column overhead (stream 38), then supplying the mixed stream to heat exchanger 22 to provide cooling of combined stream 37 and recycle stream 51*a*. This is shown in FIG. 7, where the mixed stream 50 resulting from combining the reflux separator vapor (stream 43) with the column overhead (stream 38) is routed to heat exchanger 22.

Figure 8:
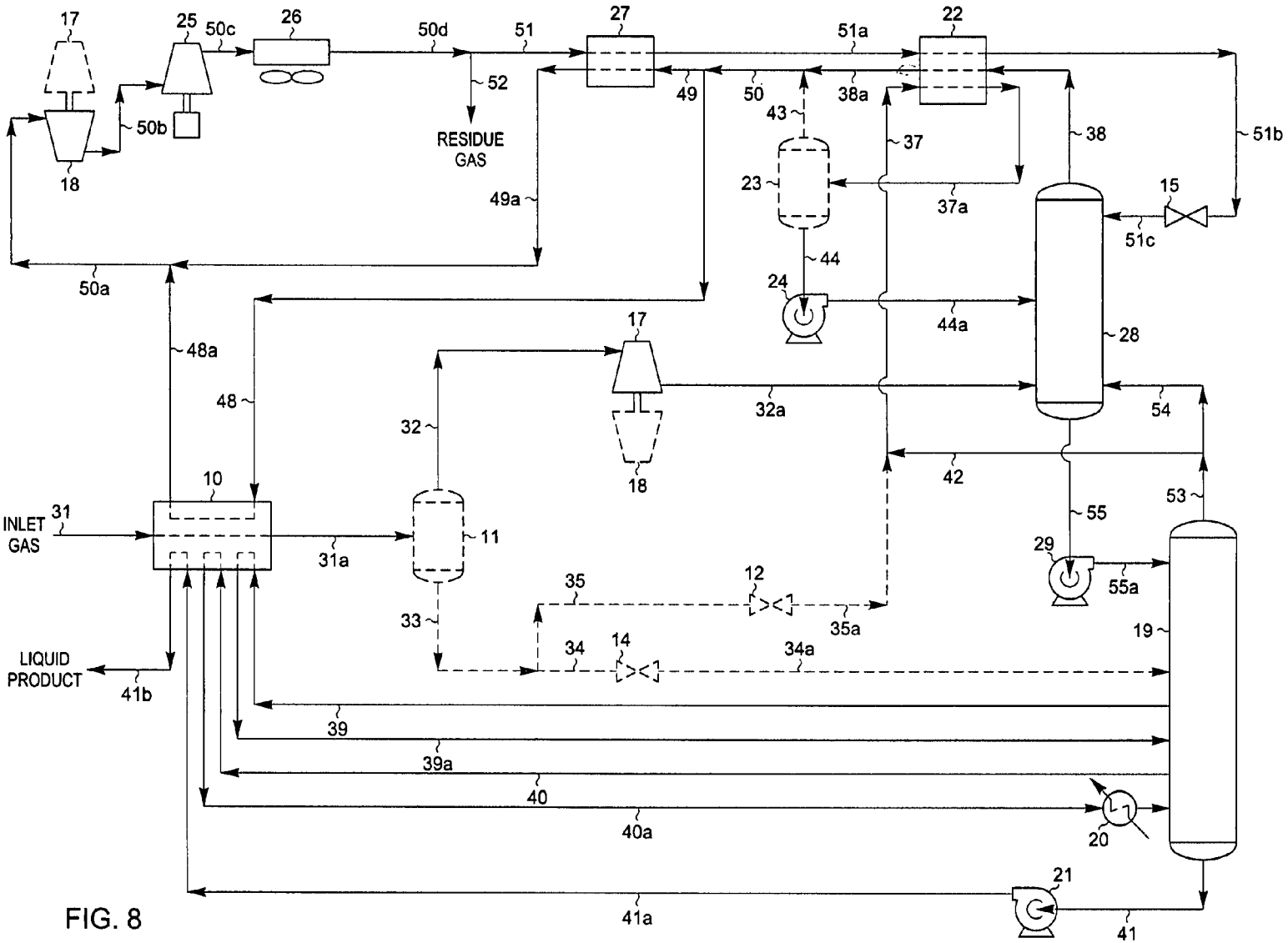

FIG. 8 depicts a fractionation tower constructed in two vessels, a contacting and separating device (or absorber column or rectifier column) 28 and distillation (or stripper) column 19. In such cases, the overhead vapor (stream 53) from stripper column 19 is split into two portions. One portion (stream 42) is combined with stream 35*a* and routed to heat exchanger 22 to generate supplemental reflux for absorber column 28. The remaining portion (stream 54) flows to the lower section of absorber column 28 to be contacted by expanded substantially condensed recycle stream 51*c* and supplemental reflux liquid (stream 44*a*). Pump 29 is used to route the liquids (stream 55) from the bottom of absorber column 28 to the top of stripper column 19 so that the two towers effectively function as one distillation system. The decision whether to construct the fractionation tower as a single vessel (such as demethanizer 19 in FIGS. 3, 5, and 7) or multiple vessels will depend on a number of factors such as plant size, the distance to fabrication facilities, etc.

Figure 9:
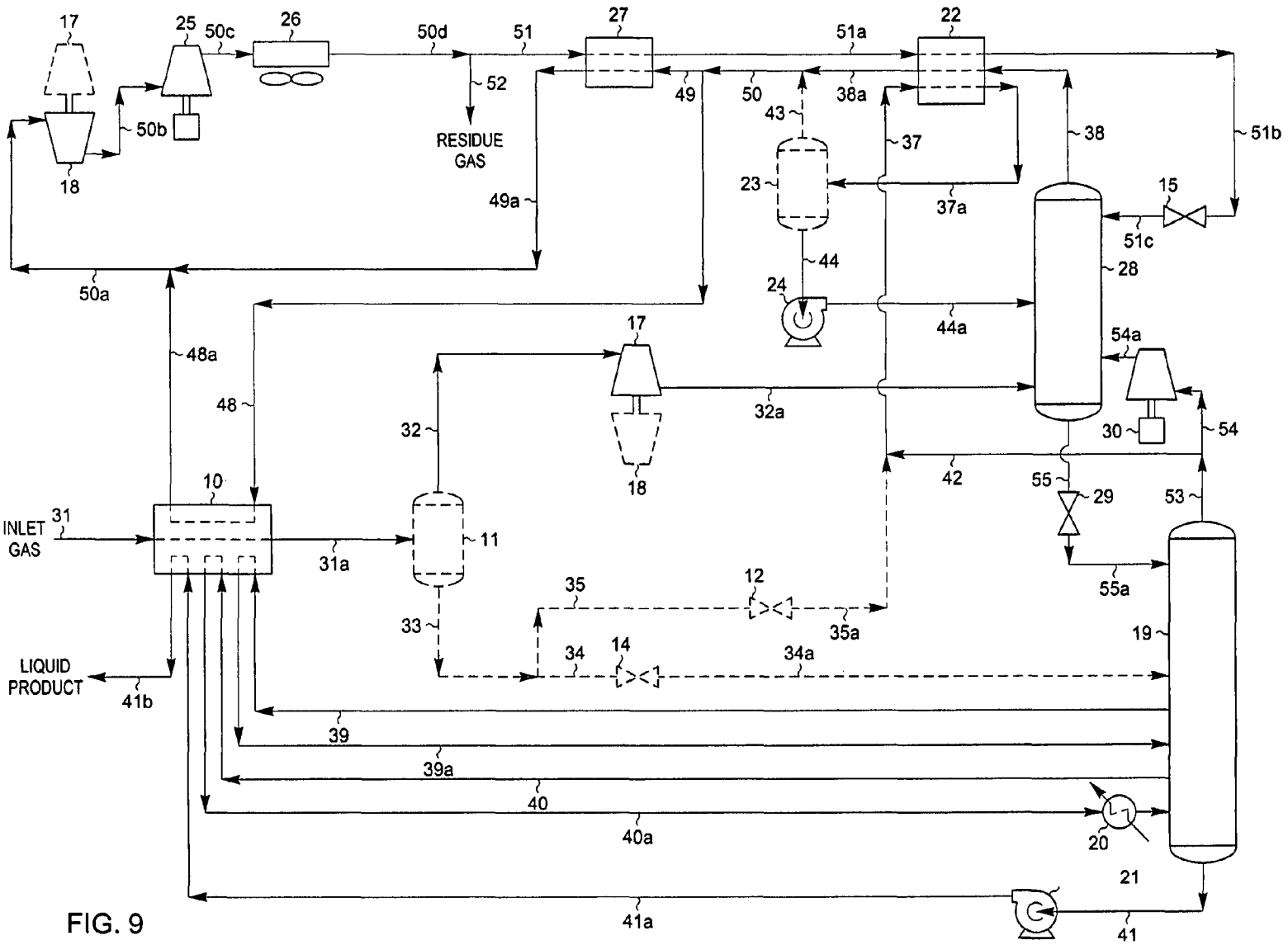
Figure 10:
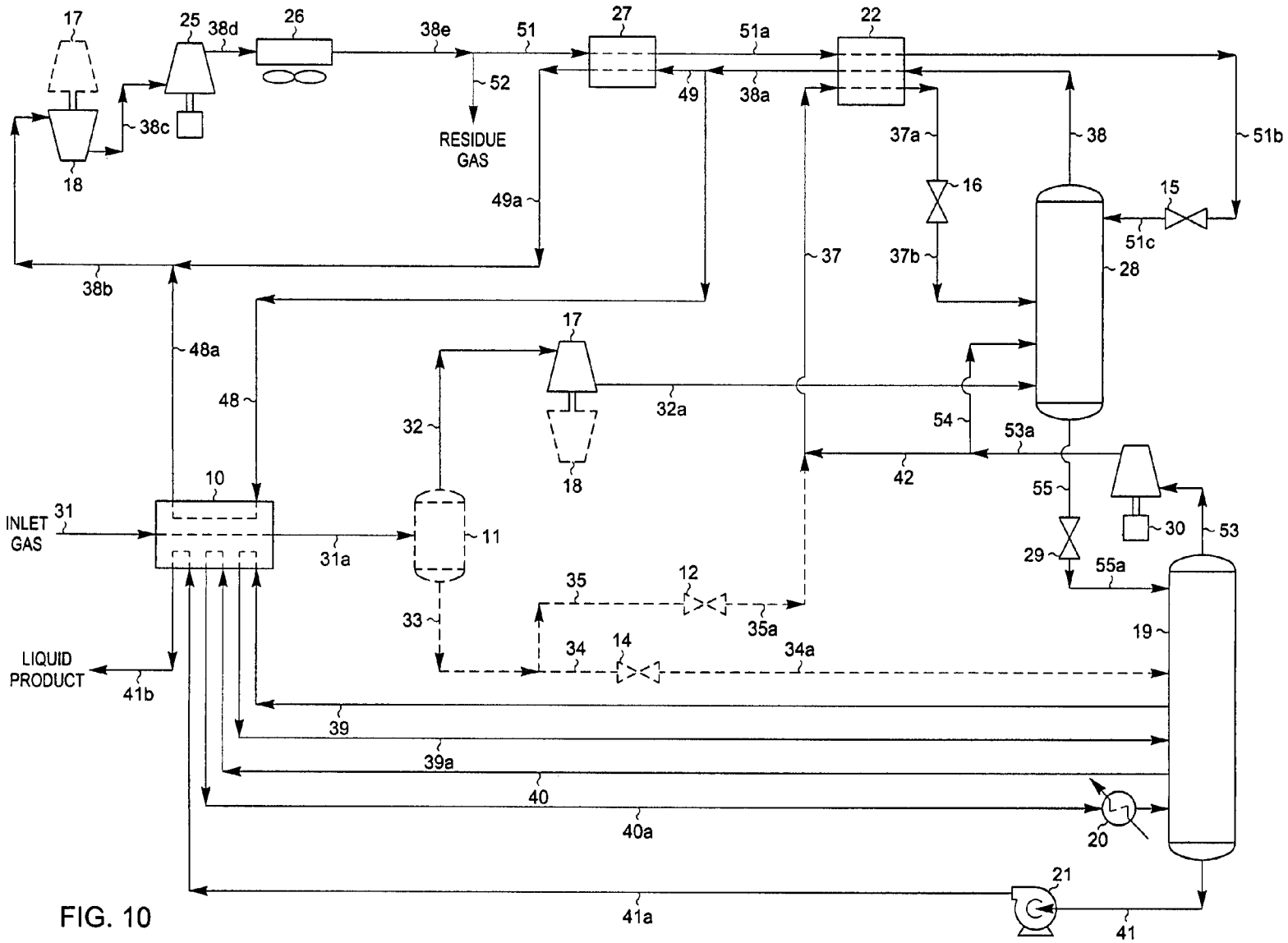

In those circumstances when the fractionation column is constructed as two vessels, it may be desirable to operate absorber column 28 at higher pressure than stripper column 19, such as the alternative embodiments of the present invention shown in FIGS. 9 and 10. In the FIG. 9 embodiment, compressor 30 provides the motive force to direct the remaining portion (stream 54) of overhead stream 53 to absorber column 28. In the FIG. 10 embodiment, compressor 30 is used to elevate the pressure of overhead stream 53 so that reflux separator 23 and pump 24 in the FIG. 9 embodiment are not required. For both embodiments, the liquids from the bottom of absorber column 28 (stream 55) will be at elevated pressure relative to stripper column 19, so that a pump is not required to direct these liquids to stripper column 19. Instead, a suitable expansion device, such as expansion valve 29 in FIGS. 9 and 10, can be used to expand the liquids to the operating pressure of stripper column 19 and the expanded stream 55*a* thereafter supplied to the top of stripper column 19.

As described in the earlier examples, the combined stream 37 is totally condensed and the resulting condensate used to absorb valuable $C_2$ components, $C_3$ components, and heavier components from the vapors rising through the lower region of absorbing section 19*b* of demethanizer 19. However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass absorbing section 19*b* of demethanizer 19. Some circumstances may favor partial condensation, rather than total condensation, of combined stream 37 in heat exchanger 22. Other circumstances may favor that distillation stream 42 be a total vapor side draw from fractionation column 19 rather than a partial vapor side draw. It should also be noted that, depending on the composition of the feed gas stream, it may be advantageous to use external refrigeration to provide some portion of the cooling of combined stream 37 in heat exchanger 22.

It is generally advantageous to totally condense combined stream 37 in order to minimize the loss of the desired $C_2$+ components in distillation stream 50. As such, some circumstances may favor the elimination of reflux separator 23 and uncondensed vapor line 43 as shown by the dashed lines in FIGS. 3, 8, and 9.

Feed gas conditions, plant size, available equipment, or other factors may indicate that elimination of work expansion machine 17, or replacement with an alternate expansion device (such as an expansion valve), is feasible. Although individual stream expansion is depicted in particular expansion devices, alternative expansion means may be employed where appropriate. For example, conditions may warrant work expansion of the substantially condensed recycle stream (stream 51*b*).

When the inlet gas is leaner, separator 11 in FIGS. 3, 5, and 7 through 10 may not be needed. Depending on the quantity of heavier hydrocarbons in the feed gas and the feed gas pressure, the cooled feed stream 31*a* leaving heat exchanger 10 in FIGS. 3, 5, and 7 through 10 may not contain any liquid (because it is above its dewpoint, or because it is above its cricondenbar), so that separator 11 shown in FIGS. 3, 5, and 7 through 10 is not required. Additionally, even in those cases where separator 11 is required, it may not be advantageous to combine any of the resulting liquid in stream 33 with distillation vapor stream 42. In such cases, all of the liquid would be directed to stream 34 and thence to expansion valve 14 and a lower mid-column feed point on demethanizer 19 (FIGS. 3, 5, and 7) or a mid-column feed point on stripping column 19 (FIGS. 8 through 10).

In accordance with this invention, the use of external refrigeration to supplement the cooling available to the inlet gas and/or the recycle gas from other process streams may be employed, particularly in the case of a rich inlet gas. The use and distribution of separator liquids and demethanizer side draw liquids for process heat exchange, and the particular arrangement of heat exchangers for inlet gas cooling must be evaluated for each particular application, as well as the choice of process streams for specific heat exchange services.

It will also be recognized that the relative amount of feed found in each branch of the split liquid feed will depend on several factors, including gas pressure, feed gas composition, the amount of heat which can economically be extracted from the feed, and the quantity of horsepower available. The relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby said cooled stream is further cooled thereby forming a further cooled expanded stream; and (c) said further cooled expanded stream is directed into a distillation column and fractionated at said lower pressure whereby the components of said relatively less volatile fraction are recovered;

the improvement wherein said further cooled expanded stream is directed to a first mid-column feed position on said distillation column; and (1) a vapor distillation stream is withdrawn from a region of said distillation column below said first mid-column feed position and is cooled sufficiently to condense at least a part of said vapor distillation stream, thereby forming a condensed stream and a residual vapor stream containing any uncondensed vapor remaining after said vapor distillation stream is cooled;

(2) at least a portion of said condensed stream is supplied to said distillation column at a second mid-column feed position above said first mid-column feed position;

(3) an overhead vapor stream is withdrawn from an upper region of said distillation column and is directed into heat exchange relation with at least said vapor distillation stream and heated, thereby to supply at least a portion of the cooling of step (1) and forming a heated overhead vapor stream;

(4) said heated overhead vapor stream is combined with any said residual vapor stream to form a heated combined vapor stream;

(5) said heated combined vapor stream is compressed to higher pressure and thereafter divided into said volatile residue gas fraction and a compressed recycle stream;

(6) said compressed recycle stream is cooled sufficiently to substantially condense-said compressed recycle stream, thereby forming a condensed compressed recycle stream;

(7) said substantially condensed compressed recycle stream is expanded to said lower pressure and supplied to said distillation column at a top feed position above said second mid-column feed position; and (8) quantities and temperatures of said feed streams to said distillation column are effective to maintain an overhead temperature of said distillation column at a temperature whereby the major portions of the components in said relatively less volatile fraction are recovered.

2. The process according to claim 1 wherein said gas stream is cooled sufficiently to partially condense-said gas stream, thereby forming a partially condensed gas stream; and (1) said partially condensed gas stream is separated thereby to provide a vapor stream and at least one liquid stream;

(2) said vapor stream is expanded to said lower pressure whereby said vapor stream is further cooled, and thereafter supplied to said distillation column at said first mid-column feed position; and (3) from 0% to 100% of said at least one liquid stream is expanded to said lower pressure and supplied to said distillation column at a third mid-column feed position;

(4) from 100% to 0% of said at least one liquid stream is expanded to said lower pressure and combined with said vapor distillation stream to form a combined stream;

(5) said combined stream is cooled sufficiently to condense at least a part of said combined stream, thereby forming said condensed stream and said residual vapor stream containing any uncondensed vapor remaining after said combined stream is cooled; and (6) said overhead vapor stream is directed into heat exchange relation with at least said combined stream and heated, thereby to supply at least a portion of the cooling of step (5).

3. In an apparatus for the separation of a gas stream containing methane, $C_2$ components, $C_3$ components, and heavier hydrocarbon components into a volatile residue gas fraction and a relatively less volatile fraction containing a major, portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and expand said cooled stream to a lower pressure, whereby said cooled stream is further cooled thereby forming a further cooled expanded stream; and (c) a distillation column connected to receive said further cooled expanded stream, said distillation column being adapted to separate said further cooled expanded stream into an overhead vapor stream and said relatively less volatile fraction;

the improvement wherein said apparatus includes (1) said distillation column connected to said first expansion means to receive said further cooled expanded stream at a first mid-column feed position on said distillation column;

(2) vapor withdrawing means connected to said distillation column to receive a vapor distillation stream from a region of said distillation column below said first mid-column feed position;

(3) heat exchange means connected to said vapor withdrawing means to receive said vapor distillation stream and cool said vapor distillation stream sufficiently to condense at least a part of said vapor distillation stream;

(4) first separating means connected to said heat exchange means to receive said at least partially condensed distillation stream and separate said at least partially condensed distillation stream, thereby forming a condensed stream and a residual vapor stream containing any uncondensed vapor remaining after said vapor distillation stream is cooled, said first separating means being further connected to said distillation column to supply at least a portion of said condensed stream to said distillation column at a second mid-column feed position above said first mid-column feed position;

(5) said distillation column being further connected to said heat exchange means to direct at least a portion of said overhead vapor stream separated therein into heat exchange relation with at least said vapor distillation stream and heat said overhead vapor stream, thereby to supply at least a portion of the cooling of element (3);

(6) first combining means connected to combine said heated overhead vapor stream and any said residual vapor stream into a heated combined vapor stream;

(7) compressing means connected to said first combining means to receive said heated combined vapor stream and compress said heated combined vapor stream to higher pressure;

(8) dividing means connected to said compressing means to receive said compressed heated combined vapor stream and divide said compressed heated combined vapor stream into said volatile residue gas fraction and a compressed recycle stream;

(9) second cooling means connected to said dividing means to receive said compressed recycle stream and cool said compressed recycle stream sufficiently to substantially condense said compressed recycle stream;

(10) second expansion means connected to said second cooling means to receive said substantially condensed compressed recycle stream and expand said substantially condensed compressed recycle stream to said lower pressure, said second expansion means being further connected to said distillation column to supply said expanded condensed recycle stream to said distillation column at a top feed position above said second mid-column feed position; and

(11) control means adapted to regulate the quantities and temperatures of said feed streams to said distillation column to maintain the overhead temperature of said distillation column at a temperature whereby the major portions of the components in said relatively less volatile fraction are recovered.

4. The apparatus according to claim 3 wherein said apparatus includes (1) said first cooling means being adapted to cool said gas stream under pressure sufficiently to partially condense said gas stream;

(2) second separating means connected to said first cooling means to receive said partially condensed gas stream and separate said partially condensed gas stream into a vapor stream and at least one liquid stream;

(3) said first expansion means connected to said second separating means to receive said vapor stream and expand said vapor stream to said lower pressure, said first expansion means being further connected to said distillation column to supply said expanded vapor stream to said distillation column at said first mid-column feed position;

(4) third expansion means connected to said second separating means to receive from 0% to 100% of said at least one liquid stream and expand said at least one liquid stream to said lower pressure, said third expansion means being further connected to said distillation column to supply said expanded liquid stream to said distillation column at a third mid-column feed position;

(5) fourth expansion means connected to said second separating means to receive from 100% to 0% of said at least one liquid stream and expand said at least one liquid stream to said lower pressure;

(6) second combining means connected to said fourth expansion means to receive said expanded portion, said second combining means being further connected to said vapor withdrawing means to receive said vapor distillation stream and thereby combine said streams to form a combined stream;

(7) said heat exchange means connected to said second combining means to receive said combined stream and cool said combined stream sufficiently to condense at least a part of said combined stream, said heat exchange means being further connected to supply said at least partially condensed combined stream to said first separating means; and (8) said heat exchange means being further connected to said distillation column to direct at least a portion of said overhead vapor stream separated therein into heat exchange relation with at least said combined stream and heat said overhead vapor stream, thereby to supply at least a portion of the cooling of element (7).

* * * * *